US011374361B2

(12) United States Patent
Minoru et al.

(10) Patent No.: US 11,374,361 B2
(45) Date of Patent: Jun. 28, 2022

(54) PLUG CONNECTOR, CONNECTOR SYSTEM, AND FLYING BODY

(71) Applicant: Junkosha Inc., Kasama (JP)

(72) Inventors: Sawada Minoru, Kasama (JP); Imamura Shogo, Kasama (JP)

(73) Assignee: Junkosha Inc., Kasama (JP)

( * ) Notice: Subject to any disclaimer, the term of this patent is extended or adjusted under 35 U.S.C. 154(b) by 0 days.

(21) Appl. No.: 16/969,960

(22) PCT Filed: Feb. 18, 2019

(86) PCT No.: PCT/JP2019/005923
§ 371 (c)(1),
(2) Date: Aug. 13, 2020

(87) PCT Pub. No.: WO2019/160149
PCT Pub. Date: Aug. 22, 2019

(65) Prior Publication Data

US 2020/0412062 A1 Dec. 31, 2020

(30) Foreign Application Priority Data

Feb. 16, 2018 (JP) ..... JP2018-026360

(51) Int. Cl.
*H01R 13/648* (2006.01)
*H01R 13/6471* (2011.01)
(Continued)

(52) U.S. Cl.
CPC ..... *H01R 13/6471* (2013.01); *H01R 12/71* (2013.01); *H01R 13/10* (2013.01);
(Continued)

(58) Field of Classification Search
CPC .... H01R 12/71; H01R 13/10; H01R 13/6471; H01R 13/6473; H01R 13/65912; H01R 2107/00
(Continued)

(56) References Cited

U.S. PATENT DOCUMENTS 6,213,879 B1 * 4/2001 Niizuma ..... H04L 7/0008 463/36
6,324,603 B1 * 11/2001 Niizuma ..... H04L 7/0008 710/72
(Continued)

FOREIGN PATENT DOCUMENTS

JP 201518714 A 1/2015

*Primary Examiner* — Abdullah A Riyami
*Assistant Examiner* — Vladimir Imas
(74) *Attorney, Agent, or Firm* — The Webb Law Firm

(57) ABSTRACT

(Technical Problem) To provide a lightweight and highly reliable plug connector for high-speed digital multi-channel transmission. (Technical Solution) A rigid substrate of a plug connector includes a base material having a first surface, including a first side and a second side formed opposite the first side, and a second surface formed opposite the first surface, and a plurality of signal transmission patterns configured to transmit a differential signal, and includes a first signal transmission pattern on the first surface, a second signal transmission pattern on the second surface, a third signal transmission pattern on the first surface and adjacent to the first signal transmission pattern, and a fourth signal transmission pattern on the second surface and adjacent to the second signal transmission pattern. Each signal transmission pattern includes a first conductor pattern, a second conductor pattern forming a differential pair, and a third conductor pattern having a fixed potential. Each of the first conductor pattern, the second conductor pattern, and the third conductor pattern includes a terminal portion electrically connected to a terminal of another connector, a pad
(Continued)

portion electrically connected to a cable, and a wiring portion electrically connecting the terminal portion and the pad portion. The terminal portion is formed along the first side, and the pad portion is formed along the second side.

10 Claims, 15 Drawing Sheets

(51) Int. Cl.
*H01R 13/6591* (2011.01)
*H01R 12/71* (2011.01)
*H01R 13/10* (2006.01)
*H01R 13/6473* (2011.01)
*H01R 107/00* (2006.01)

(52) U.S. Cl.
CPC ... *H01R 13/6473* (2013.01); *H01R 13/65912* (2020.08); *H01R 2107/00* (2013.01)

(58) Field of Classification Search
USPC ..... 439/607.05
See application file for complete search history.

(56) References Cited

U.S. PATENT DOCUMENTS 7,052,311 B2 * 5/2006 Kondou ..... H01R 13/65912 439/497
7,453,338 B2 * 11/2008 Aronson ..... H01R 13/6585 333/260
7,538,276 B2 * 5/2009 Narumi ..... H01B 7/0838 174/117 F
7,840,242 B2 * 11/2010 Yoshino ..... H01R 9/032 455/575.2
8,267,718 B2 * 9/2012 Straka ..... H01R 13/6471 439/497
8,367,932 B2 * 2/2013 Matsumoto ..... H01B 11/203 174/110 R
8,764,464 B2 * 7/2014 Buck ..... H01R 13/6587 439/108
9,035,183 B2 * 5/2015 Kodama ..... H05K 3/3405 174/74 R
9,083,159 B2 * 7/2015 Takeuchi ..... H02G 3/0475
9,124,037 B2 * 9/2015 Smink ..... H01R 13/6461
9,161,436 B2 * 10/2015 Havermann ..... H01R 12/53
9,373,915 B1 * 6/2016 Schulz ..... H01R 13/6594
9,466,925 B2 * 10/2016 Rost ..... H01R 9/032
9,570,821 B2 * 2/2017 Yamakami ..... H01R 12/515
9,882,306 B2 * 1/2018 Pao ..... H01R 13/26
9,887,496 B2 * 2/2018 Janssen ..... H01R 13/6594
10,062,984 B2 * 8/2018 Regnier ..... H01R 13/6473
10,103,453 B2 * 10/2018 Pao ..... H01R 13/6595
10,165,671 B2 * 12/2018 Bugg ..... H01R 12/62
10,411,374 B2 * 9/2019 Tanaka ..... H01R 12/53
10,615,524 B2 * 4/2020 Gross ..... H01R 13/514
10,741,942 B2 * 8/2020 Sekido ..... A61B 1/0011
2006/0252310 A1 * 11/2006 Yamada ..... H01R 12/598 439/579
2009/0277665 A1 * 11/2009 Kumamoto ..... H05K 1/0245 174/113 R
2013/0264107 A1 * 10/2013 Meyers ..... H05K 1/0218 174/268
2014/0051288 A1 2/2014 Smink et al.
2014/0349496 A1 * 11/2014 Zhu ..... H05K 1/0219 439/108
2015/0144391 A1 5/2015 Havermann

* cited by examiner

PLUG CONNECTOR, CONNECTOR SYSTEM, AND FLYING BODY

CROSS-REFERENCE TO RELATED APPLICATIONS

This application is the United States national phase of International Application No. PCT/JP2019/005923 filed Feb. 18, 2019, and claims priority to Japanese Patent Application No. 2018-026360 filed Feb. 16, 2018, the disclosures of which are hereby incorporated by reference in their entirety.

TECHNICAL FIELD

The present invention relates to a plug connector, a connector system, and a flying body.

BACKGROUND ART

Differential transmission technology has been adopted for high-speed digital multi-channel transmission. Differential transmission is a method in which currents having opposite phases are made to flow through two signal lines such that transmission is performed based on the potential difference between the signal lines. Differential transmission has characteristics in that, even when the same noise is applied from the outside to signal lines of a + (positive) side and a − (negative) side in order to cause a potential difference between the signal lines, the noise is cancelled, and thus malfunction seldom occurs.

As a signal cable used for differential transmission, a shielded cable, which has two signal lines, through which currents having opposite phases flow, and a shield line, covering these two signal lines, is known. It is required to use a shielded cable to connect high-speed digital processing devices in a manner such that the shielded cable is maintained in a balanced state. In a connector system, which has a plug connector and a socket connector used for connection of a shielded cable, it is required to maintain electrical symmetry and characteristic impedance in order to maintain the balanced state of the shielded cable. Further, in order to stabilize the characteristics, the positional relationship and structure of a conductor and a dielectric need to be stabilized.

Particularly, in the case of high-speed digital multi-channel transmission using a differential transmission method, for example, in the case in which a transmission rate is 1.5 Gbit/sec or higher and the number of channels is 32 or more, it is further required to maintain the electrical symmetry and characteristic impedance of the connector system.

Patent Document 1 discloses a connector for adjusting impedance. The connector has a resin substrate, on the surface of which a plurality of contacts including a signal contact and a ground contact, which are connected to a plurality of coaxial cables, is disposed. The connector further has a ground plate, which is composed of a main portion parallel to the surface of the substrate and a bent portion perpendicular to the main portion, and is configured such that one ground contact is electrically connected to the ground plate so as to adjust impedance.

RELATED ART DOCUMENTS

Patent Documents

Patent Document 1: Japanese Patent Laid-open Publication No. 2015-18714

DISCLOSURE

Technical Problem

However, in high-speed digital multi-channel transmission using a differential transmission method, with the structure of the connector described in Patent Document 1, it is impossible to maintain electrical symmetry of the connector, and it is difficult to maintain characteristic impedance. Further, the weight increases due to the complicated connection path. Therefore, particularly in applications where vibration or acceleration is applied, additional reinforcement is necessary, resulting in a vicious circle of increase in weight. This increase in weight adversely affects the mounting portion of the connector.

Technical Solution

The present invention has been made in order to solve these problems, and it is an object of the present invention to propose a lightweight and highly reliable plug connector for high-speed digital multi-channel transmission.

In order to accomplish the above object, a plug connector according to the present invention is a plug connector including a rigid substrate having a first surface and a second surface formed opposite the first surface, wherein each of the first surface and the second surface of the rigid substrate includes a first side and a second side formed opposite the first side, the rigid substrate includes a plurality of signal transmission patterns formed on the first surface and the second surface to transmit a differential signal, the plurality of signal transmission patterns includes a first signal transmission pattern formed on the first surface of the rigid substrate, a second signal transmission pattern formed on the second surface of the rigid substrate, a third signal transmission pattern formed at a position adjacent to the first signal transmission pattern on the first surface, and a fourth signal transmission pattern formed at a position adjacent to the second signal transmission pattern on the second surface, the plurality of signal transmission patterns includes a first conductor pattern, a second conductor pattern forming a differential pair with the first conductor pattern, and a third conductor pattern having a fixed potential, each of the first conductor pattern, the second conductor pattern, and the third conductor pattern includes a terminal portion electrically connected to a terminal of another connector, a pad portion electrically connected to a cable, and a wiring portion electrically connecting the terminal portion and the pad portion, the terminal portion of each of the first, second and third conductor patterns of the plurality of signal transmission patterns is formed along the first side, and the pad portion of each of the first, second and third conductor patterns is formed along the second side.

In addition, the rigid substrate of the plug connector according to the present invention includes a third side located between the first side and the second side and a fourth side formed opposite the third side, and the distance between the first side and the second side is less than the distance between the third side and the fourth side.

In addition, in each of the first conductor pattern, the second conductor pattern, and the third conductor pattern of the plug connector according to the present invention, the wiring portion is formed in a straight line connecting the terminal portion and the pad portion, to which the wiring portion is connected.

In addition, in the plug connector according to the present invention, the distance between the first side of the first surface of the rigid substrate and the pad portion is less than 0.1% of the wavelength of the differential signal.

In addition, the rigid substrate of the plug connector according to the present invention further includes a first inner surface, formed along the first surface and having a first conductor plate, and a second inner surface, formed along the second surface and having a second conductor plate, and the distance between the first conductor plate and the second conductor plate is less than the distance between the first conductor pattern formed on the first surface and the first conductor plate.

In addition, a connector system according to the present invention is a connector system including a plug connector, including a rigid substrate having a first surface and a second surface formed opposite the first surface, and a socket connector, including a plurality of pins supporting the first surface and the second surface of the rigid substrate sandwiched therebetween, wherein a plurality of conductor patterns is formed on the first surface and the second surface of the rigid substrate so as to extend parallel to each other, each of the plurality of conductor patterns having a pad portion formed at one end thereof for connection with a cable and a terminal portion formed at an opposite end thereof for contact with a respective one of the pins, the plurality of pins of the socket connector is configured such that end portions thereof opposite the portions supporting the rigid substrate sandwiched therebetween support a top surface and a bottom surface of another wiring substrate sandwiched therebetween, the rigid substrate includes a first signal transmission pattern formed on the first surface, a second signal transmission pattern formed on the second surface of the base material, a third signal transmission pattern formed on the first surface at a position adjacent to the first signal transmission pattern, and a fourth signal transmission pattern formed on the second surface at a position adjacent to the second signal transmission pattern, the plurality of signal transmission patterns includes three conductor patterns disposed adjacent to each other, the three conductor patterns including a first conductor pattern, a second conductor pattern forming a differential pair with the first conductor pattern, and a third conductor pattern having a fixed potential, and, when a plane located between the top surface and the bottom surface of the other wiring substrate such that the distance from the top surface and the distance from the bottom surface are the same is defined as a first virtual plane, a transmission path composed of three conductor patterns constituting the first signal transmission pattern and three pins configured to be in contact with terminal portions of the three conductor patterns does not intersect the first virtual plane, and a transmission path composed of three conductor patterns constituting the second signal transmission pattern and three pins configured to be in contact with terminal portions of the three conductor patterns does not intersect the first virtual plane.

In addition, a flying body according to the present invention includes any one of the above-described plug connector or the above-described connector system.

Figure 1:
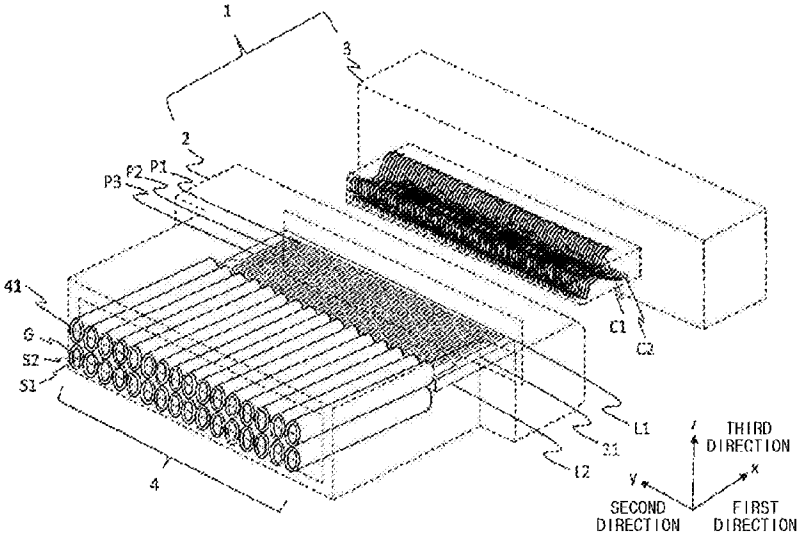
FIG. 1 is a view illustrating an example of a connector system according to the present invention.

MODE FOR INVENTION (Outline of Connector System)

Hereinafter, the structure of a connector system according to one aspect of the present disclosure will be described with reference to the drawings. However, it should be noted that the technical scope of the present disclosure is not limited to the embodiments set forth herein, and covers the invention described in the claims and equivalents thereof. Further, in the following description and the accompanying drawings, components having the same functional configurations are denoted by the same reference numerals, and a duplicate explanation thereof is omitted.

FIG. 1 is a view illustrating a connector system 1 having a plug connector 2 and a socket connector 3 according to an embodiment of the present invention.

First, the first direction, the second direction, and the third direction shown in FIG. 1 will be described. In the shown right-handed orthogonal system having an x-axis, a y-axis, and a z-axis, the first direction corresponds to the x-axis direction, the second direction corresponds to the y-axis, and the third direction corresponds to the z-axis. The first direction is a direction that is oriented from the plug connector 2 toward the socket connector 3, which is connected to the plug connector 2. Alternatively, the first direction is a direction in which the plug connector 2, which is connected to the socket connector 3, is inserted into the socket connector 3. In addition, in FIG. 2 and the drawings below, the first direction, the second direction, and the third direction are similarly defined, unless otherwise specified.

As shown in FIG. 1, the plug connector 2 includes a rigid substrate 21. The rigid substrate 21 may be disposed inside the exterior part of the plug connector 2 indicated by the broken line. Further, the exterior part may be omitted. The rigid substrate 21 is connected to a cable group 4 for high-speed digital multi-channel transmission using a differential transmission method. In the connection portion with the rigid substrate 21, the cable group 4 has a two-layered structure in which one layer, in which a plurality of shielded cables 41, each having a first signal line S1, a second signal line S2, and a shield line G, is arranged in parallel, is stacked on another layer.

Differential transmission is realized by supplying signal currents of opposite phases to the first signal line S1 and the second signal line S2. The shield line G is formed so as to surround the first signal line S1 and the second signal line S2 in order to prevent crosstalk between shielded cables and to prevent the introduction of external noise. High-speed digital transmission is performed using a high transmission bit rate, for example, 3.0 Gbit/sec. Since a high frequency with a fundamental frequency of 1.5 GHz is used for a bit rate of 3.0 Gbit/sec, it is important to prevent crosstalk and external noise.

Multi-channel transmission, for example, transmission of 32 or more channels, is performed. The cable group 4 having a two-layered structure of the present embodiment has 16 channels per layer, that is, 16 shielded cables 41, and has a total of 32 shielded cables.

The rigid substrate 21 has two flat surfaces formed in the first direction and the second direction, which are a first surface L1 and a second surface L2, which is opposite the first surface L1. The first surface L1 and the second surface L2 are preferably parallel to each other.

Each of the first surface L1 and the second surface L2 has a first side formed at the portion thereof that is connected to the socket connector 3. In addition, each of the first surface L1 and the second surface L2 has a second side formed opposite the first side. In addition, a third side located between the first side and the second side and a fourth side, which is a side opposite the third side, are included. Three conductor patterns, namely a first conductor pattern P1, a second conductor pattern P2, and a third conductor pattern P3, which are respectively electrically connected to the first signal line S1, the second signal line S2, and the shield line G of each shielded cable 41 of the cable group 4, are formed on the two flat surfaces L1 and L2 of the rigid substrate 21.

Here, the combination of the three conductor patterns, namely the first conductor pattern P1, the second conductor pattern P2, and the third conductor pattern P3, which are connected to one shielded cable 41, is defined as one signal transmission pattern.

The conductor patterns P1, P2 and P3 on the first surface L1 and the second surface L2 extend in the first direction from the portions thereof that are electrically connected to the first signal line S1, the second signal line S2, and the shield line G of the shielded cable 41.

The socket connector 3, which is coupled to the plug connector 2 and is indicated by broken line, is electrically and mechanically coupled to the plug connector 2 to thereby constitute the connector system 1 together with the plug connector. The socket connector 3 has a plurality of first pins C1 and a plurality of second pins C2 for contact with the respective conductor patterns formed on the first surface L1 and the second surface L2 of the rigid substrate 21 of the plug connector 2.

The first pins C1 are brought into contact with the respective conductor patterns P1, P2 and P3 on the first surface L1 at one or more contact points, and thus are electrically connected to the respective conductor patterns P1, P2 and P3. The second pins C2 are brought into contact with the respective conductor patterns P1, P2 and P3 on the second surface L2 at one or more contact points, and thus are electrically connected to the respective conductor patterns P1, P2 and P3. Since the pins C1 and C2 are in contact with the respective conductor patterns P1, P2 and P3 at one or more contact points, while supporting the rigid substrate 21 sandwiched therebetween, even when acceleration is suddenly applied to the connector system 1, it is possible to maintain electrical contact between the pins C1 and C2 and the conductor patterns P1, P2 and P3.

The ends of the first pins C1 and the second pins C2, which are opposite the portions thereof that are in contact with the conductor patterns, are connected to a board, on which the components of an electronic device (not shown) are mounted.

It is possible to realize highly reliable high-speed digital multi-channel transmission between electronic devices using the connector system 1 of the present embodiment. Although the high-speed digital multi-channel transmission using a differential transmission method has been described by way of example in the present embodiment, the connector system 1 is applicable to any transmission methods using a shielded cable, other than the high-speed digital multi-channel transmission.

(Explanation of Shielded Cable)

Figure 2:
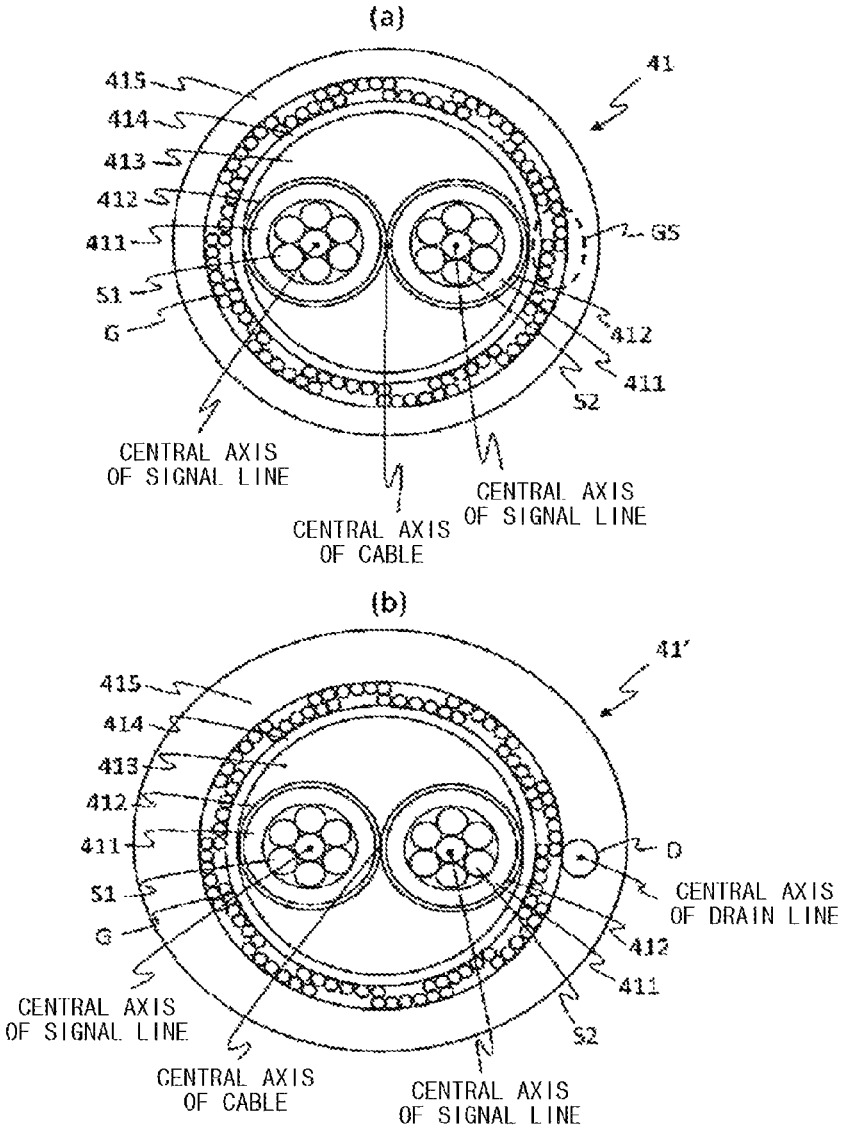
FIG. 2 is a view illustrating an example of a shielded cable having a circular-shaped cross-section.
Figure 3:
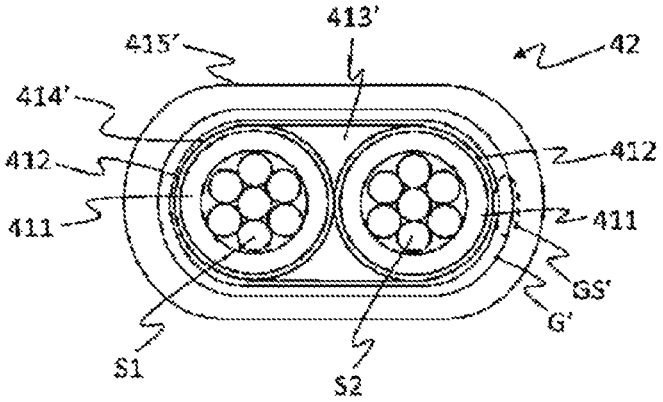
FIG. 3 is a view illustrating an example of a shielded cable having a flat cross-section.

FIGS. 2 and 3 are views illustrating shielded cables according to the present embodiment. FIG. 2 is a view illustrating shielded cables 41 and 41' having circular-shaped cross-sections. FIG. 3 is a view illustrating a shielded cable 42 having a flat cross-section, rather than a circular-shaped cross-section. The shielded cables 41, 41' and 42 may be used together or separately.

FIG. 2(*a*) is a view illustrating the shielded cable 41 having a circular-shaped cross-section. FIG. 2(*b*) is a view illustrating the shielded cable 41' having a drain line D.

The shielded cable 41 has two signal lines S1 and S2, which are arranged with the central axis of the shielded cable interposed therebetween, and further has a shield line G surrounding the two signal lines. The signal lines S1 and S2 are conductors formed by twisting, for example, copper wires. Alternatively, the copper wires may be disposed parallel to each other, rather than being twisted. The copper wires may be, for example, copper wires having a metal layer such as silver formed on the surface thereof through plating or the like. Alternatively, copper-coated steel wires or copper-coated aluminum wires may be used. The shield line G is, for example, a conductor in which copper wires are braided. The two signal lines S1 and S2 and the shield line G are electrically insulated from each other, and are configured to be capable of transmitting mutually different signals. In the present embodiment, the shield line G has a fixed potential. The shield line G may have a potential equivalent to the ground potential of a housing. Each of the two signal lines S1 and S2 includes a first inner coating material 411, which is configured as a sheet of dielectric resin tape wound around the conductor. The dielectric resin tape is composed of fluororesin, for example, polytetrafluoroethylene (PTFE) or porous expanded polytetrafluoroethylene (EPTFE), which is made through stretch processing. The outer circumference of the first inner coating material 411 is coated with a second inner coating material 412, which is composed of fusible fluororesin, for example, tetrafluoroethylene/hexafluoropropylene copolymer (FEP). The second inner coating material 412 may be made of polyethylene resin.

In addition, in order to maintain the circularity of the cross-section of the shielded cable 41, the shielded cable 41 has a filling coating material 413, which contains thread-like fusible fluororesin, for example, EPTFE, in the composition thereof. The outer circumference of the filling coating material 413 is coated with a fixed coating material 414, which is configured as a sheet of resin tape, for example, a sheet of polyethylene terephthalate (PET) resin tape. Accordingly, the coated signal lines S1 and S2 and the filling coating material 413 are fixedly combined, thereby maintaining the circularity of the cross-section of the shielded cable 41.

In addition, the outer circumference of the fixed coating material 414 is coated with the shield line G. The shield line G is formed by braiding, for example, a copper wire. For example, the braided copper wire may be a silver-plated copper wire, or may be a copper-coated aluminum wire formed by coating copper on aluminum in order to reduce the weight thereof. The outer circumference of the shield line G is coated with an outer coating material 415 in order to maintain insulation. For example, the outer coating material 415 is composed of FEP.

Only a portion GS of the shield line G braided with a copper wire is cut out, so that the conductor pattern P3 on the rigid substrate 21 and the shield line G are electrically connected to each other. It is preferable for the cut-out portion GS of the shield line G to include the position at which the line connecting the central axes of the two signal lines S1 and S2 intersects the shield line. When the central axes of the two signal lines S1 and S2 and the central axis of the cut-out portion GS are in the same plane, the geometrical arrangement for the respective connections between the conductor patterns P1, P2 and P3 on the rigid substrate 21 and the signal lines S1 and S2 and the shield line G of the shielded cable 41 becomes uniform. The reason for making the geometrical arrangement uniform is to easily realize electrical symmetry. Further, it is possible to minimize the distance of each connection.

FIG. 2(*b*) is a view illustrating the shielded cable 41' having the drain line D. The drain line D is a conductor line that is in contact with the outer circumferential portion of the shield line G. Therefore, the potential of the drain line D is the same as that of the shield line G. When the drain line D is used instead of the shield line G in order to electrically connect the conductor pattern P3 on the rigid substrate 21 and the shield line G, it is not necessary to cut out the portion GS of the shield line G.

The configuration of the shielded cable 41' having the drain line D is the same as that of the shielded cable 41 shown in FIG. 2(*a*), except that the drain line D is included. The drain line D is formed by twisting, for example, one copper wire or a plurality of copper wires. The diameter of the drain line D is preferably equal to the diameter of each of the signal lines S1 and S2. The drain line D is preferably located on a straight line connecting the central axes of the two signal lines S1 and S2.

FIG. 3 is a view illustrating the shielded cable 42 having a flat cross-section, rather than having a circular-shaped cross-section. The constituent components of the shielded cable 42 are the same as those of the shielded cable 41 shown in FIG. 2(*a*). However, although, like the filling coating material 413, the filling coating material 413' contains thread-like fusible fluororesin, for example, EPTFE, in the composition thereof, the amount thereof that is charged is less than that of the filling coating material 413, thereby maintaining the flatness of the cross-section of the shielded cable. In addition, the outer circumference of the filling coating material 413' is coated with a fixed coating material 414', which is configured as a sheet of resin tape, for example, a sheet of PET resin tape. The coated signal lines S1 and S2 and the filling coating material 413' are fixedly combined, and a sheet of resin tape is wound around the combination so as to maintain the flatness of the cross-section of the shielded cable. The shield line G' and the outer coating material 415' have flat cross-sections. It is preferable for the cut-out portion GS' of the shield line G' to be located on a straight line connecting the central axes of the two signal lines S1 and S2. Alternatively, a drain line D' (not shown), which is in contact with the shield line G', may be included, and it is preferable for the drain line D' to be located on a straight line connecting the central axes of the two signal lines S1 and S2.

(Explanation of Cable Group)

Figure 4:
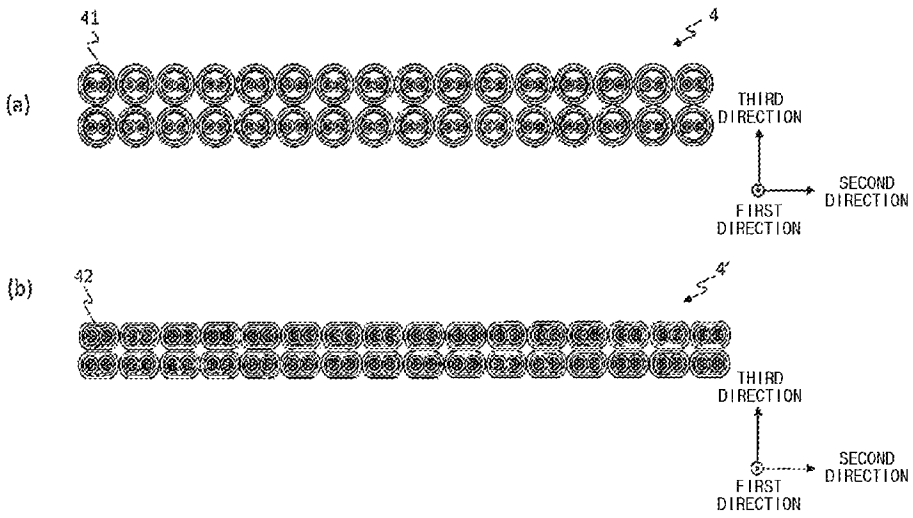
FIG. 4 is a view illustrating examples of a cable group.

FIG. 4 is a view schematically illustrating embodiments of the cable group used in the present embodiment. FIG. 4(*a*) is a cross-sectional view schematically illustrating the cable group 4 constituted by the shielded cables 41 having circular-shaped cross-sections. FIG. 4(*b*) is a cross-sectional view schematically illustrating the cable group 4' constituted by the shielded cables 42 having flat cross-sections.

The present embodiment includes a cable group 4 having a 32-channel transmission path for a high-speed digital multi-channel transmission using a differential transmission method. The cable group 4 has a two-layered structure in which two layers, in each of which sixteen shielded cables 41 are arranged in the second direction, are stacked on each other in the third direction. Since the cable group 4 has a two-layered structure that is oriented in the third direction, it is possible to suppress the increase in the width of the cable group 4 in the second direction attributable to an increase in the number of channels.

Since the shielded cables 41 in each of the two layers are arranged parallel to each other in the second direction, one plane including the central axes of the respective shielded cables 41 is defined in each layer. The shielded cables 41 are arranged such that the central axis of the first signal line S1, the central axis of the second signal line S2, and the central axis of the portion GS cut in the shield line G or the drain line D of the shielded cable 41 are laid in one plane including the central axes of the respective shielded cables 41.

Further, the first signal S1, the second signal S2, and the portion GS cut in the shield line G or the drain line D (hereinafter, the portion GS cut in the shield line G or the drain line D is referred to as a fixed potential line) of each of the plurality of shielded cables 41, which are arranged such that the central axes thereof are located in the same plane, are repeatedly arranged in the order of S1, S2, the fixed potential line, S1, S2, the fixed potential line, . . . , S1, S2, the fixed potential line, S1, S2, and the fixed potential line.

Further, the repeated arrangement of the first signal line S1, the second signal line S2, and the fixed potential line, in the order of S1, S2, the fixed potential line, S1, S2, the fixed potential line, . . . , S1, S2, the fixed potential line, S1, S2, and the fixed potential line, is equally implemented in the two layers of the cable group 4. Further, it is preferable that the first signal lines S1, the second signal lines S2, and the fixed potential lines arranged in the two layers overlap each other in the third direction.

The first signal line S1, the second signal line S2, and the fixed potential line of each shielded cable 41 of the cable group 4 are arranged uniformly, whereby the electrical connection portion between the cable group 4 and the rigid substrate 21 is electrically symmetrical.

FIG. 4(*b*) is a cross-sectional view schematically illustrating the cable group 4' constituted by the shielded cables 42 having flat cross-sections. Similar to the cable group 4, the first signal line S1, the second signal line S2, and the portion GS' cut in the shield line G of each shielded cable 42 of the cable group 4' are arranged uniformly, whereby the electrical connection portion between the cable group 4' and the rigid substrate 21 is electrically symmetrical.

In FIGS. 4(*a*) and 4(*b*), the cable group 4 preferably includes cables 41 (42), each of which has a contact region with another cable 41 (42) located adjacent to each of both sides thereof in the second direction. Further, the cable group 4 preferably includes cables 41 (42), each of which has a contact region with another cable 41 (42) located at an overlapping position in the third direction.

In the contact region between the cable 41 (42) and another cable 41 (42), the cable and the other cable may include a mutually fixed region due to adhesion therebetween, in which the relative position therebetween in the longitudinal direction thereof is fixed. However, when the mutually fixed region is equal to or greater than half the total length of the cable 41 (42), it is not only difficult to bend the cable group 4 at the time of routing, but there is also concern that the restoring force, by which the cable group 4 is restored to the original shape thereof, may apply a large load to the connection part. For this reason, the mutually fixed region is preferably 10% or less of the total length of the cable 41 (42), and is more preferably 3% or less thereof.

(Explanation of Plug Connector)

Figure 5:
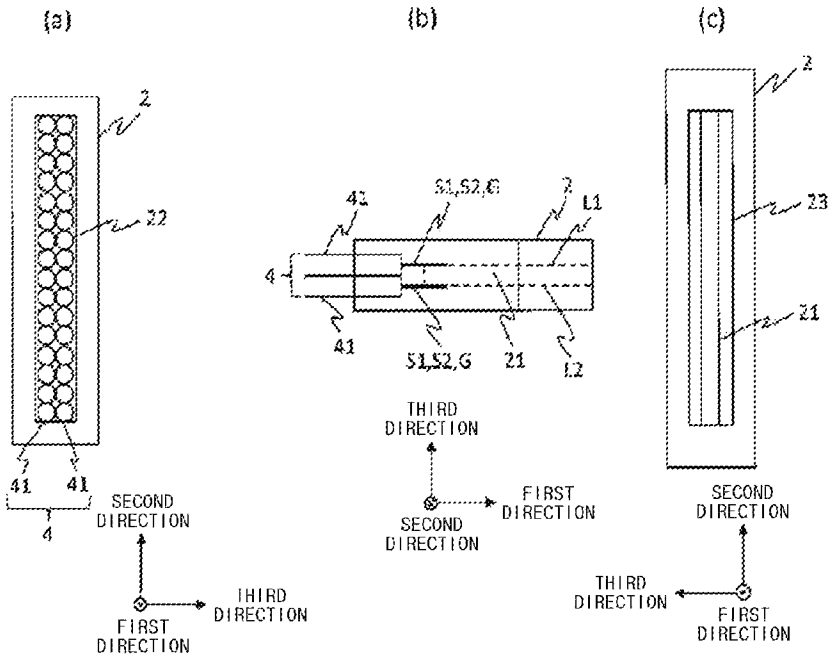
FIG. 5 is a view schematically illustrating an example of a plug connector.

FIG. 5 is a view schematically illustrating an example of the plug connector 2. FIG. 5(*a*) is a view of the plug connector 2 when viewed from the cable side thereof, FIG. 5(*b*) is a side view of the plug connector 2, and FIG. 5(*c*) is a view of the plug connector 2 when viewed from the engagement side thereof (the side oriented toward the socket connector 3).

As shown in FIG. 5(*b*), the plug connector 2 has therein a rigid substrate 21. The rigid substrate 21 has two flat surfaces formed in the first direction and the second direction, which are a first surface L1 and a second surface L2. A first conductor pattern P1, which is connected to the first signal line S1 of each shielded cable 41, a second conductor pattern P2, which is connected to the second signal line S2, and a third conductor pattern P3, which is connected to the fixed potential line, are disposed on each of the first surface L1 and the second surface L2. The number of conductor patterns disposed on the first surface L1 and the second surface is set according to the number of channels to be connected.

The plug connector 2 may have an exterior part that protects the rigid substrate 21. As shown in FIG. 5(*a*), the exterior part has a cable opening 22 formed therein. The cable group 4 according to the present embodiment, which includes 32 shielded cables corresponding to 32 channels, is inserted into the cable opening 22. A socket-connector opening 23 is formed in the right surface of the plug connector 2, as shown in FIG. 5(*c*). The conductor patterns P1, P2 and P3 disposed on the first surface L1 and the second surface L2 of the rigid substrate are electrically connected at the ends thereof, which are opposite the sides connected to the shielded cables 41, to the pins of the socket connector 3 through the socket-connector opening 23. The opening 22 has the shape of a rectangle, the short side of which has a length equivalent to twice the diameter of the cable and the long side of which has a length equivalent to the length obtained by multiplying the diameter of the cable by half the total number of channels.

(Explanation of Rigid Substrate)

Figure 6:
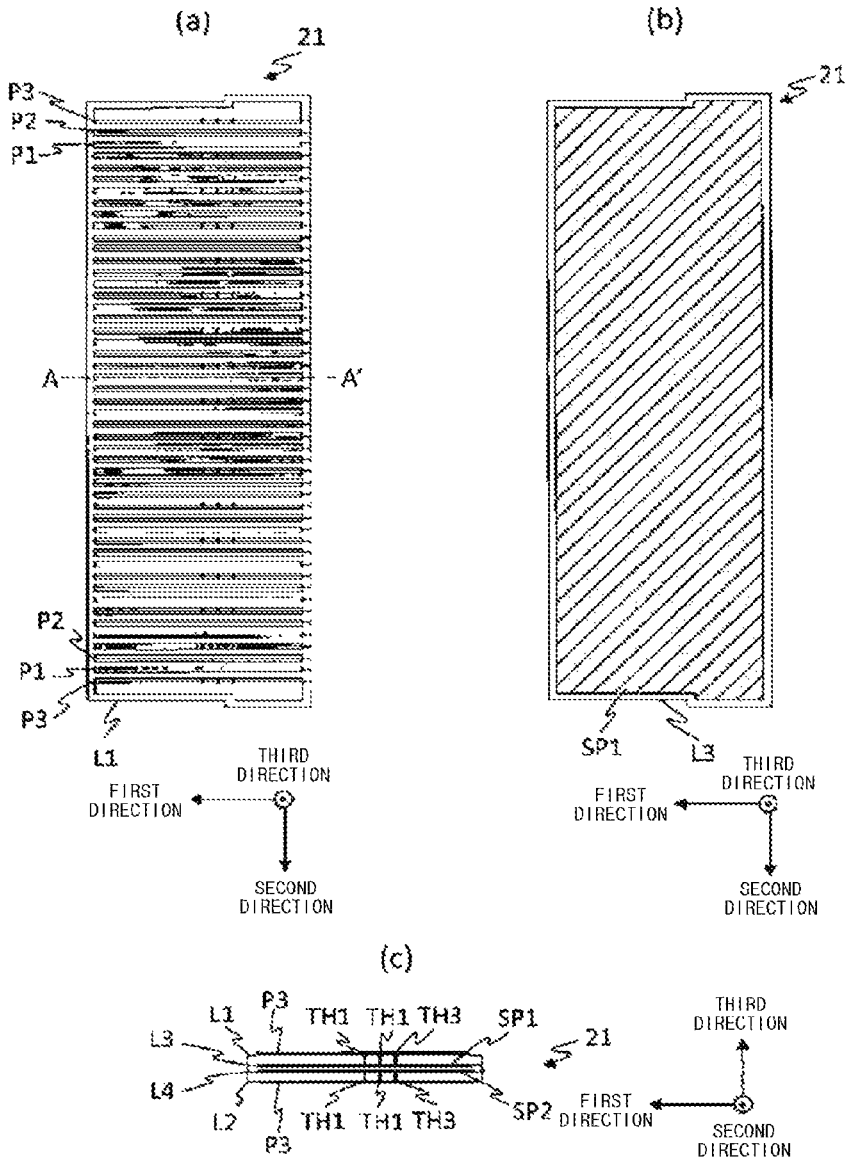
FIG. 6 is a view illustrating an example of a rigid substrate.

FIG. 6 is a view schematically illustrating an example of the rigid substrate 21. FIG. 6(*a*) is a plan view of the rigid substrate 21. FIG. 6(*b*) is a view illustrating the inner-layer surface of the rigid substrate 21. FIG. 6(*c*) is a view illustrating the cross-section taken along line A-A' in FIG. 6(*a*).

A plurality of signal transmission patterns is arranged on the first surface L1 of the rigid substrate 21. Each signal transmission pattern is a pattern that is configured as a conductor formed on a base material made of an insulating material, and includes a first conductor pattern P1, which is connected to the first signal line S1 of each shielded cable 41, a second conductor pattern P2, which is connected to the second signal line S2, and a third conductor pattern P3, which is connected to the fixed potential line. With regard to the shielded cables 41 constituting the cable group 4, the first signal line S1, the second signal line S2, and the fixed potential line are arranged in the order of the first signal line S1, the second signal line S2, and the fixed potential line. The first signal lines S1, the second signal lines S2, and the fixed potential lines of all of the shielded cables are arranged in the order of the first signal line S1, the second signal line S2, and the fixed potential line.

Accordingly, the first conductor pattern P1, the second conductor pattern P2, and the third conductor pattern P3 are repeatedly arranged in the order of the first conductor pattern P1, the second conductor pattern P2, and the third conductor pattern P3.

Further, the rigid substrate 21 has a second surface L2 that is opposite the first surface L1, and a first conductor pattern P1, which is connected to the first signal line S1 of each shielded cable 41, a second conductor pattern P2, which is connected to the second signal line S2, and a third conductor pattern P3, which is connected to the fixed potential line, are disposed on the second surface L2, like the first surface L1. The arrangement of the first conductor pattern P1, the second conductor pattern P2, and the third conductor pattern P3 on the second surface L2 is the same as that on the first surface L1. The first conductor pattern P1, the second conductor pattern P2, and the third conductor pattern P3 on the second surface L2 preferably include regions where they respectively overlap the first conductor pattern P1, the second conductor pattern P2, and the third conductor pattern P3 on the first surface when viewed in plan. The configuration in which the conductor patterns on the first surface L1 and the second surface L2 include overlapping regions when viewed in plan helps maintain electrical symmetry in the rigid substrate 21. Further, it is more preferable that not only the conductor patterns on the first surface L1 and the second surface L2 but also the regions between the conductor patterns include overlapping positions when viewed in plan. Particularly, preferably, the conductor patterns on the first surface L1 and the conductor patterns on the second surface L2 have the same shape and the same size as each other, and are arranged such that the patterns at both ends overlap when viewed in plan.

In the present embodiment, the respective conductor patterns P1, P2 and P3 formed on the first surface are linear patterns. The direction of extension of these patterns is a direction intersecting the first side of the first surface, and it is particularly preferable that the direction of extension and the first side be orthogonal to each other. The linear patterns have the same length, and are arranged parallel to each other according to the number of channels that are required. One end of each linear pattern is arranged along the first side, and the opposite end of each conductor pattern is arranged along the second side. Further, the conductor patterns P1, P2 and P3 formed on the second surface also have the same configuration.

Furthermore, it is preferable that the length of the region in which the conductor patterns are arranged along the first side be greater than the length of each linear pattern (the length in a direction parallel to the second side). That is, the distance between the first side and the second side of the rigid substrate is less than the distance between the third side and the fourth side.

With some or all of the above configuration, it is possible not only to provide highly reliable high-density electrical connection but also to provide high-speed multi-channel transmission exhibiting minimal difference in the characteristics between the signal transmission patterns, excellent versatility, and capability to flexibly respond to design changes.

The copper-containing ratio in each of the first surface L1 and the second surface L2 of the rigid substrate 21 (the ratio of the total conductor area to the total area of a base material when viewed in plan) is preferably 40% or more. Conductor patterns other than the first conductor pattern P1, the second conductor pattern P2, and the third conductor pattern P3 may be further included in the first surface L1 and the second surface L2, but it is preferable to set the area thereof to a predetermined level or less. The ratio of the total area occupied by the first conductor pattern P1, the second conductor pattern P2, and the third conductor pattern P3 to the total conductor area is preferably 70% or more, and is more preferably 90% or more.

Here, conductor patterns that form conduction paths between the connection positions with the respective cables and the contact positions with the pins of the socket connector are included in the total area occupied by the first conductor pattern P1, the second conductor pattern P2, and the third conductor pattern P3. Conductor patterns that do not have conduction paths with the above conductor patterns on the first surface L1 (or the second surface L2) are not included.

The rigid substrate 21 may further include therein a conductive layer. FIG. 6(*b*) is a view illustrating a first inner surface L3 formed along the first surface L1 of the rigid substrate 21. The first surface L1 and the first inner surface L3 are preferably parallel to each other. The first inner surface L3 has a first conductor plate SP1. The first conductor plate SP1 is made by forming, for example, a copper foil or a copper mesh. The first conductive plate SP1 is preferably formed such that the images of all of the first to third conductor patterns of the first surface L1 projected onto the first inner surface L3 are included in the first conductor plate.

FIG. 6(*c*) is a view illustrating the cross-section taken along line A-A' in the rigid substrate of FIG. 6(*a*). The rigid substrate 21 has a first surface L1 on the front surface thereof and a second surface L2 on the rear surface thereof, which is opposite the front surface. A first inner surface L3 formed along the first surface and a second inner surface L4 formed along the second surface L2 are formed inside the rigid substrate. It is preferable that the first surface L1 and the first inner surface L3 be parallel to each other and that the second surface L2 and the second inner surface L4 be parallel to each other. Further, it is preferable that the first inner surface L3 and the second inner surface L4 be parallel to each other.

Like the first inner surface L3, the second inner surface L4 has a second conductor plate SP2. The second conductor plate SP2 is made by forming, for example, a copper foil or a copper mesh. The first conductor plate SP1 and the second conductor plate SP2 include an overlapping portion when viewed in plan. The ratio of the area of the overlapping region between the first conductor plate SP1 and the second conductor plate SP2 when viewed in plan to the total area of the first conductor plate SP1 is preferably 90% or more, and is more preferably 95% or more. Most preferably, the first conductor plate SP1 and the second conductor plate SP2 have the same shape and the same size.

The plurality of third conductor patterns P3 on the first surface L1, which is connected to the fixed potential lines, is electrically connected to the first conductor plate SP1 on the first inner surface L3. For example, one or more through-holes are used for electrical connection. In the present embodiment, three through-holes TH1, TH2 and TH3 are used for connection. The fixed potential lines and the first conductor plate SP1 have the same potential due to the electrical connection between the third conductor patterns P3 on the first surface, which is connected to the fixed potential lines, and the first conductor plate SP1.

Similarly, the third conductor patterns P3 on the second surface L2, which are connected to the fixed potential lines, are electrically connected to the second conductor plate SP2 on the second inner surface L4 through three through-holes TH1, TH2 and TH3. The fixed potential lines and the second conductor plate SP2 have the same potential due to the electrical connection between the third conductor patterns P3 on the second surface, which is connected to the fixed potential lines, and the second conductor plate SP2. The through-holes TH may be formed so as to penetrate the substrate so that the third conductor patterns P3 on the first surface, the first conductor plate SP1, the second conductor plate SP2, and the third conductor patterns P3 on the second surface have the same potential.

Furthermore, the distance between the first surface L1 and the first inner surface L3 is equal to the distance between the second surface L2 and the second inner surface L4. Cross-talk of a signal flowing through the first surface L1 and a signal flowing through the second surface L2 is suppressed by the first conductor plate SP1, which has the same potential as the fixed potential lines near the first surface, and the second conductor plate SP2, which has the same potential as the fixed potential lines near the second surface.

The first surface L1, the first inner surface L3, the second inner surface L4, and the second surface L2 are spaced apart from each other using an insulating base material such as an epoxy resin or a glass epoxy resin. Alternatively, the first inner surface L3 and the second inner surface L4 may be bonded to each other using thermocompression bonding or an adhesive such as an epoxy-based resin, or may be bonded to each other using a conductive adhesive.

Figure 7:
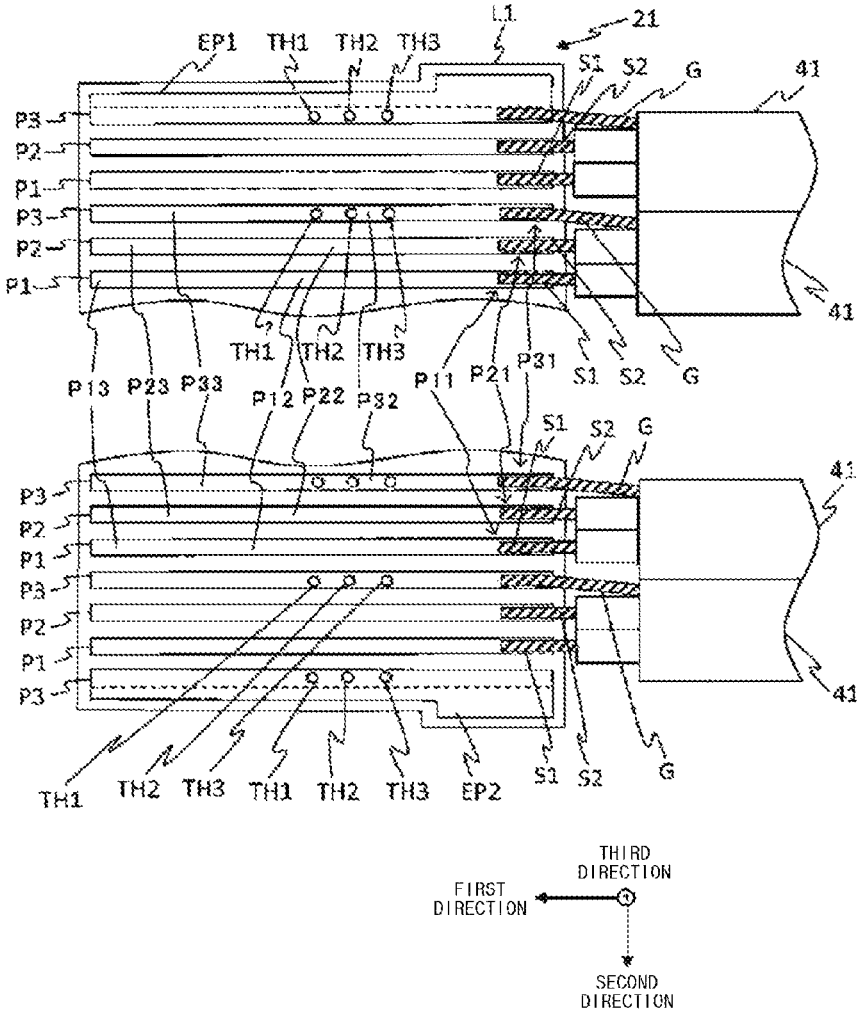
FIG. 7 is an enlarged view illustrating the connection state between the rigid substrate and the shielded cable.

FIG. 7 is an enlarged view illustrating the connection state between the first surface L1 of the rigid substrate 21 and the shielded cables 41.

The first conductor pattern P1, which is connected to the first signal line S1 of the shielded cable 41, the second conductor pattern P2, which is connected to the second signal line S2, and the third conductor pattern P3, which is connected to the fixed potential line, extend from the second side, which is located at the connection portion with the shielded cable 41, in the first direction of the first surface. Preferably, the first conductor pattern P1, the second conductor pattern P2 connected to the second signal line S2, and the third conductor pattern P3 connected to the fixed potential line are arranged at regular intervals. Further, the conductor patterns P1, P2 and P3 preferably have the same conductor width.

The interval at which the conductor patterns are arranged is preferably equal to the interval between the central axis of the first signal line S1 and the central axis of the second signal line S2 of the shielded cable 41. The reason for this is that, when the central axis of each signal line and the central line of each conductor pattern in the direction of extension are laid on the same straight line, imbalance of characteristic impedance is reduced. The interval at which the conductor patterns are arranged may be 97% to 103% of the interval between the central axis of the first signal line S1 and the central axis of the second signal line S2 of the shielded cable 41.

In the present embodiment, since 16 shielded cables are connected to the first surface, 16 conductor patterns P1, P2 and P3 are arranged at regular intervals in the order of P1, P2 and P3. That is, the conductor patterns P1, P2 and P3 are repeated in the order of P1, P2 and P3, and are arranged at regular intervals in the second direction, orthogonal to the first direction. Among the patterns repeatedly arranged at regular intervals in the second direction, the initial pattern is the third conductor pattern P3, which is connected to the fixed potential line.

The conductor patterns P1, P2 and P3 respectively include pad portions P11, P21 and P31, which are connection regions with the signal lines or the shield lines. These pad portions are arranged along the second side of the first surface L1 or along the second side of the second surface L2 of the rigid substrate 21.

In addition, the conductor patterns P1, P2 and P3 respectively include terminal portions P13, P23 and P33, which are regions with which the pins of the socket connector 3 are in contact. These terminal portions are arranged along the first side of the first surface L1 or along the first side of the second surface L2 of the rigid substrate 21. In addition, the conductor patterns P1, P2 and P3 include wiring portions P12, P22 and P32, which are formed between the pad portions and the terminal portions of the respective conductor patterns in order to form conduction paths substantially between the pad portions and the terminal portions. These wiring portions may be formed to extend in a direction perpendicular to the first side of the first surface L1 or the second surface L2 of the rigid substrate 21.

The initial third conductor pattern P3 may have an expanded pattern EP1, which extends toward the outside of the rigid substrate 21 in the second direction. The expanded pattern EP1 is preferably a conductor pattern in which the portion thereof extending from the pad portion P31 is wider than the portion thereof extending from the terminal portion P33. The purpose of this is to reduce the influence of electromagnetic waves radiated from the first signal line S1 and the second signal line S2 of the shielded cable.

When the initial conductor pattern, among the conductor patterns repeatedly arranged at regular intervals in the second direction, is the third conductor pattern P3, which is connected to the fixed potential line, the last conductor pattern in the repetition is the first conductor pattern P1, which is connected to the first signal line S1. It is preferable that a void third conductor pattern P3, which is not connected to the fixed potential line, be further disposed along the last conductor pattern P1 in the repetition, preferably at an interval therefrom that is the same as the repetition interval in the second direction. In addition, it is preferable for the void third conductor pattern P3 to have an expanded pattern EP2, which extends toward the outside of the rigid substrate 21. The expanded pattern EP2 is preferably a conductor pattern in which the portion thereof extending from the pad portion P31 is wider than the portion thereof extending from the terminal portion P33. Further, the shape of the expanded pattern EP1 extending from the initial third conductor pattern P3 and the shape of the expanded pattern EP2 extending from the void third conductor pattern P3 are preferably the same as each other. The purpose of this is to maintain geometric symmetry.

Each third conductor pattern P3 connected to the fixed potential line is electrically connected to the first conductor plate SP1 on the first inner surface L3 through three through-holes TH1, TH2 and TH3. For example, the connection is realized by plating the through-holes. Alternatively, a method of charging a conductive paste, for example, a silver paste or a copper paste, in the through-holes may be used. The void third conductor pattern P3, which is not connected to the fixed potential line, is also electrically connected to the first conductor plate SP1 on the first inner surface L3 through three through-holes TH1, TH2 and TH3. Accordingly, the void third conductor pattern P3, which is not connected to the fixed potential line, also has the same potential as the fixed potential line.

Figure 8:
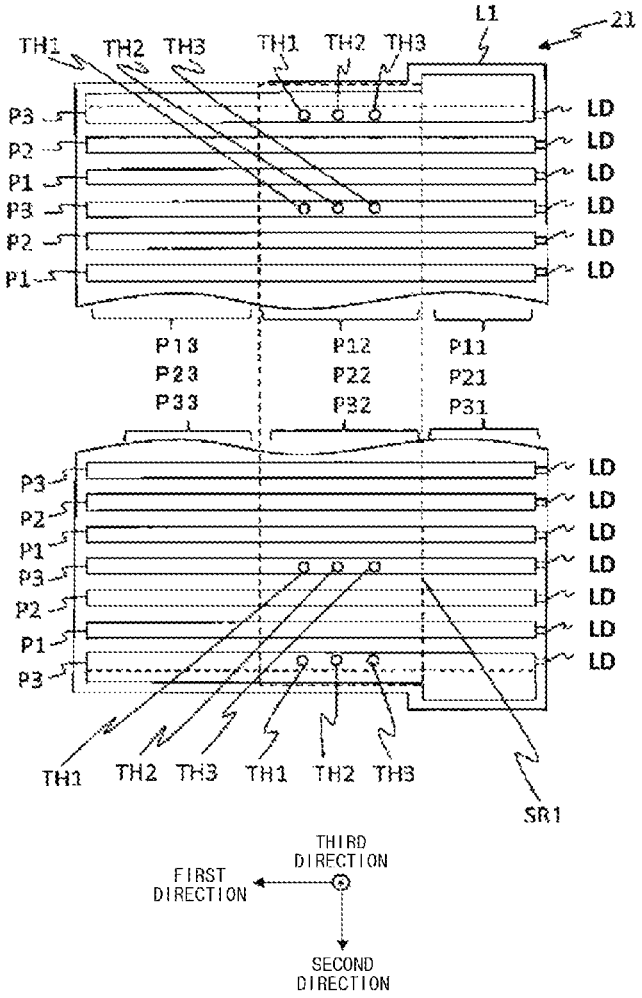
FIG. 8 is an enlarged view of a first surface of the rigid substrate.

FIG. 8 is an enlarged view of the first surface L1 for explaining the respective conductor patterns on the first surface L1 of the rigid substrate 21.

The first conductor pattern P1 has a first pad portion P11, which is connected to the first signal line S1, a first wiring portion P12, which extends in the first direction and has one end connected to the first pad portion P11, and a first terminal portion P13, which is connected to the opposite end of the first wiring portion. The widths of the first pad portion P11, the first wiring portion P12, and the first terminal portion P13 in the second direction may be different from each other. For example, the width of the first terminal portion P13 may be set to be greater than that of each of the first pad portion P11 and the first wiring portion P12 so as to improve the electrical connection with the pins C1 of the socket connector 3.

Similarly, the second conductor pattern P2 has a second pad portion P21, which is connected to the second signal line S2, a second wiring portion P22, which extends in the first direction and has one end connected to the second pad portion P21, and a second terminal portion P23, which is connected to the opposite end of the second wiring portion. The widths of the second pad portion P21, the second wiring portion P22, and the second terminal portion P23 in the second direction may be different from each other.

The third conductor pattern P3 has a third pad portion P31, which is connected to the fixed potential line, a third wiring portion P32, which extends in the first direction and has one end connected to the third pad portion P31, and a third terminal portion P33, which is connected to the opposite end of the third wiring portion. The third wiring portion P32 is electrically connected to the first conductor plate SP1 on the first inner surface L3 through three through-holes TH1, TH2 and TH3. Further, the number of through-holes is not limited to three, and may be one or more, and it is preferable for the through-holes to be located near the edge of the substrate such that, for example, stubs large enough to affect transmission characteristics are not formed at the copper foil portions of L1 and L3 in the substrate layer.

The third terminal portion P33 may be set to be longer toward the socket connector 3 in the first direction than the first terminal portion P13 and the second terminal portion P23. In other words, the distance between the third terminal portion P33 and the first side may be shorter than the distance between each of the first terminal portion P13 and the second terminal portion P23 and the first side. With this configuration, when the plug connector 2 and the socket connector 3 are connected, the connection with the first pins C1 of the socket connector 3 is realized prior to the connection of the first terminal portion P13 and the second terminal portion P23 to the first pins C1, thereby protecting the circuit.

The pin of the socket connector 3 that comes into contact with the third terminal portion P33 of the plug connector 2 may be set to be longer toward the plug connector in the first direction than the pins that come into contact with the first terminal portion P13 and the second terminal portion P23. The reason for this is to realize contact between the third terminal portion P33 of the plug connector 2 and the pin earlier than contact between other connecting parts.

The surfaces of the first pad portion P11, which is connected to the first signal line S1 of the shielded cable, the second pad portion P21, which is connected to the second signal line S2, and the third pad portion P31, which is connected to the fixed potential line, are plated with an alloy including tin (Sn). The plated layers serve to improve connectivity.

The surfaces of the first terminal portion P13, the second terminal portion P23, and the third terminal portion P33, which are in contact with the first pins C1 of the socket connector 3, are plated with an alloy including gold (Au) or tin (Sn). The plated layers serve to improve electrical contact with the first pins C1.

As indicated by the broken line in the drawing, a resist SR is formed on the surfaces of the first wiring portion P12, the second wiring portion P22, and the third wiring portion P32. The resist SR is an insulator layer that includes a filler such as a thermosetting resin or a metal oxide. The resist protects the wiring portions P12, P22 and P32, and limits the region in which molten solder spreads during soldering. The region in which the resist is formed is not limited to the wiring portions. The resist SR may be formed on the pad portions and/or the terminal portions, as long as an open region or the like is provided to expose regions of the conductor patterns that are necessary for connection.

It is preferable for the first conductor pattern P1 and the second conductor pattern P2 to have the same shape and the same size. Further, it is preferable for the first conductor pattern P1, the second conductor pattern P2, and the third conductor pattern P3 to have the same shape and the same size. It is possible to reduce the imbalance of characteristic impedance by maintaining electrical symmetry. Furthermore, even when the first conductor pattern P1, the second conductor pattern P2, and the third conductor pattern P3 are different from each other, since the combination of the first conductor pattern P1, the second conductor pattern P2, and the third conductor pattern P3, which corresponds to one shielded cable 41, is repeated, electrical symmetry is maintained.

When electrolytic plating is used for surface treatment of the pad portions and/or the terminal portions, the rigid substrate 21 may have plated lead wires LD, which serve as power supply paths during electrolytic plating. The plated lead wires are preferably formed between the second side and the respective pad portions on the first surface L1 and/or the second surface L2.

Here, the width of the plated lead wire (the dimension of the conductor in the second direction) is set to be less than the width of the wiring portion P12 of the conductor pattern (the dimension of the conductor in the second direction), so that the increase in the weight of the rigid substrate is minimized even when the rigid substrate 21 has a large number of plated lead wires, i.e. two to three times as many as the number of channels.

Figure 9:
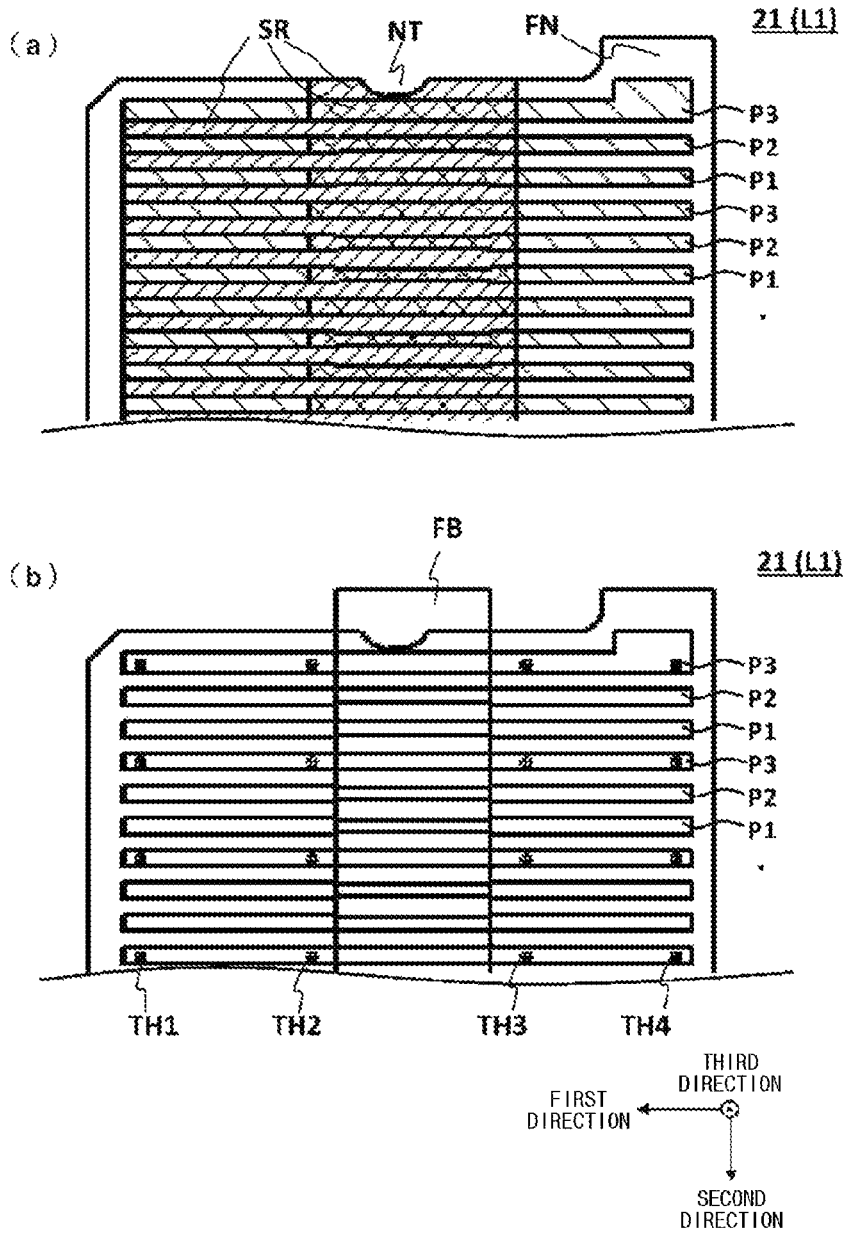
FIG. 9 is an enlarged view of a first surface of a rigid substrate according to another embodiment.

FIG. 9 is an enlarged view of a first surface of a rigid substrate according to another embodiment. Since FIGS. 9(*a*) and 9(*b*) illustrate the same part, they may be somewhat redundant with each other, but are provided separately for the sake of explanation. In the present embodiment, a notch NT and a fin FN are formed on the third side and/or the fourth side of the rigid substrate 21. Further, the region in which the resist SR is formed covers the wiring portions of the conductor patterns, and also fills the space between the terminal portions of the conductor patterns. In FIG. 9(*a*), the region hatched by oblique lines in the direction from the upper-left portion to the lower-right portion of the paper sheet indicates the conductor patterns, and the region hatched by oblique lines in the direction from the upper-right portion to the lower-left portion of the paper sheet indicates the resist-formed region. The region in which the two oblique lines overlap indicates the region in which the resist is formed on the conductor patterns. Further, in the present embodiment, each third conductor pattern P3 has four through-holes TH therein. Among the same, two through-holes TH1 and TH4 are formed in opposite end portions of the conductor pattern. With this configuration, it is possible not only to obtain improved transmission characteristics but also to provide a rigid substrate that is less likely to be damaged by mechanical stress when the socket is inserted/removed into/from the plug.

Referring to FIG. 9(*b*), in the present embodiment, the rigid substrate includes a rigid substrate support plate FB, which defines a fixed position of the rigid substrate with respect to other constituent members of the plug connector. The rigid substrate support plate FB is a member that has therein a slit penetrating the rigid substrate. For example, it is made of an insulating polymer material having a larger elastic modulus than the resist material, and is formed directly on the rigid substrate, or is formed thereon with an adhesive layer interposed therebetween. Referring to FIG. 9(*a*), the rigid substrate support plate FB is disposed in the resist-formed region. Further, the notch NT is formed at a position overlapping the rigid substrate support plate FP.

The conductor patterns P1 and P2 may be formed such that the line width thereof at the position overlapping the rigid substrate support plate FB is less than the line width thereof in a not-overlapping region. With this configuration, it is possible to minimize not only a change in the dielectric constant due to the arrangement of the substrate support plate FB but also a change in the impedance of the signal transmission path.

Figure 10:
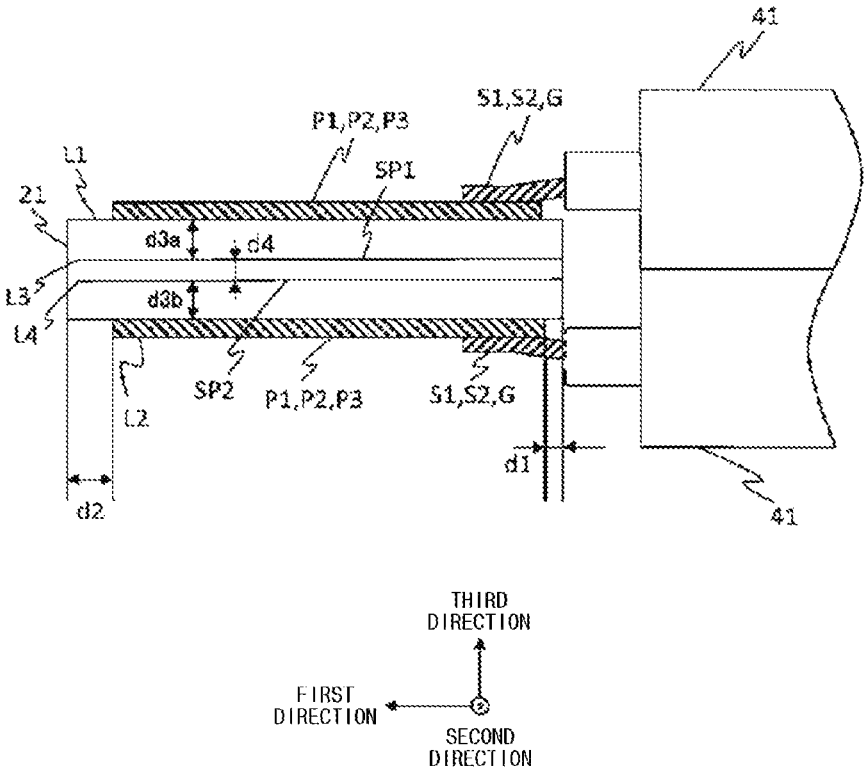
FIG. 10 is a view illustrating the positional relationship between the rigid substrate, a conductor pattern, and the shielded cable.

FIG. 10 is a view illustrating the positional relationship between the rigid substrate, the conductor patterns, and the shielded cables.

It is possible to suppress the disturbance of the characteristic impedance by setting the distance d1 between the second side of the rigid substrate 21 and the end of the pad portion of each of the conductor patterns P1, P2 and P3 to be less than a predetermined value. Therefore, for example, d1 is preferably less than the distance between the conductor pattern on the first surface and the conductor pattern on the second surface of the rigid substrate. Alternatively, d1 may be less than the distance d2 between the end of the terminal portion of the conductor pattern and the first side. d1 may be 0 mm.

When it is required to suppress peeling of the conductor patterns, d1 may be set to be equal to or greater than the thicknesses of the conductor patterns P1, P2 and P3.

The length of the disturbed portion of the characteristic impedance may be ignored if it is sufficiently short with respect to the actual wavelength of the transmitted signal. For example, when the transmission rate is 3 Gbit/sec, the fundamental frequency is 1.5 GHz, and the wavelength in free space is about 200 mm. In the case of being sufficiently shorter than the wavelength, for example, in the case of about 0.2 mm, which is less than 0.1% of the wavelength, the influence on the transmission is small. The same applies to the positions of the ends of the conductor patterns P1, P2 and P3 on the first surface.

The first conductor plate SP1 of the first inner surface L3 and the second conductor plate SP2 of the second inner surface L4 are less likely to undergo peeling of the patterns, and may be contiguous to the side that is connected to the respective shielded cables 41.

Alternatively, they may be formed so as to be spaced apart from the first side or the second side, thereby obtaining a plug connector that is highly reliable as well as lightweight.

The thickness of the rigid substrate 21 is preferably equal to the interlayer distance of the cable group 4. The interlayer distance is the distance between the central axes of the shielded cables in two layers of the cable group 4. For example, the first signal line S1 may be connected linearly to the first conductor pattern. When the transmission path is linear, there is little variation in the characteristic impedance, and since there is no bent portion, emission of electromagnetic waves is reduced. When a layer that is made of a conductor and includes the conductor patterns P1, P2 and P3 formed on the first surface L1 is defined as a first surface conductive layer, when a layer that is made of a conductor and includes the conductor patterns P1, P2 and P3 formed on the second surface L2 is defined as a second surface conductive layer, when a layer that is made of a conductor and includes the first conductor plate SP1 formed on the first inner surface L3 is defined as a first intermediate conductive layer, and when a layer that is made of a conductor and includes the second conductor plate SP2 formed on the second inner surface L4 is defined as a second intermediate conductive layer, the distance d3*a* between the first surface conductive layer and the first intermediate conductive layer is the same as the distance d3*b* between the second surface conductive layer and the second intermediate conductive layer. Here, the same distance means that the distance of one side falls within a range from 0.9 times to 1.1 times the distance of the other side. The same applies to the following description unless otherwise specified. Further, it is preferable to set the distance d4 between the first intermediate conductive layer and the second intermediate conductive layer to be less than d3*a* and d3*b*. Accordingly, it is possible to reduce the weight of the rigid substrate 21 while maintaining excellent impedance characteristics.

Further, it is possible to provide a rigid substrate 21 having a thickness corresponding to the interlayer distance of the cable group 4 by adjusting d4.

Furthermore, the thickness of the first surface conductive layer and the thickness of the second surface conductive layer are the same. Preferably, the thickness of the first surface conductive layer, the thickness of the second surface conductive layer, the thickness of the first intermediate conductive layer, and the thickness of the second intermediate conductive layer are all the same. Here, the same thickness means that the thickness of one side falls within a range from 0.9 times to 1.1 times the thickness of the other side. The same applies to the following description unless otherwise specified.

The fact that the transmission path is preferably linear also applies to each of the conductor patterns P1, P2 and P3. Therefore, it is preferable that the pad, the wiring, and the pin, which constitute each conductor pattern, be linearly connected.

(Explanation of Resist Structure of Terminal Portion)

Figure 11:
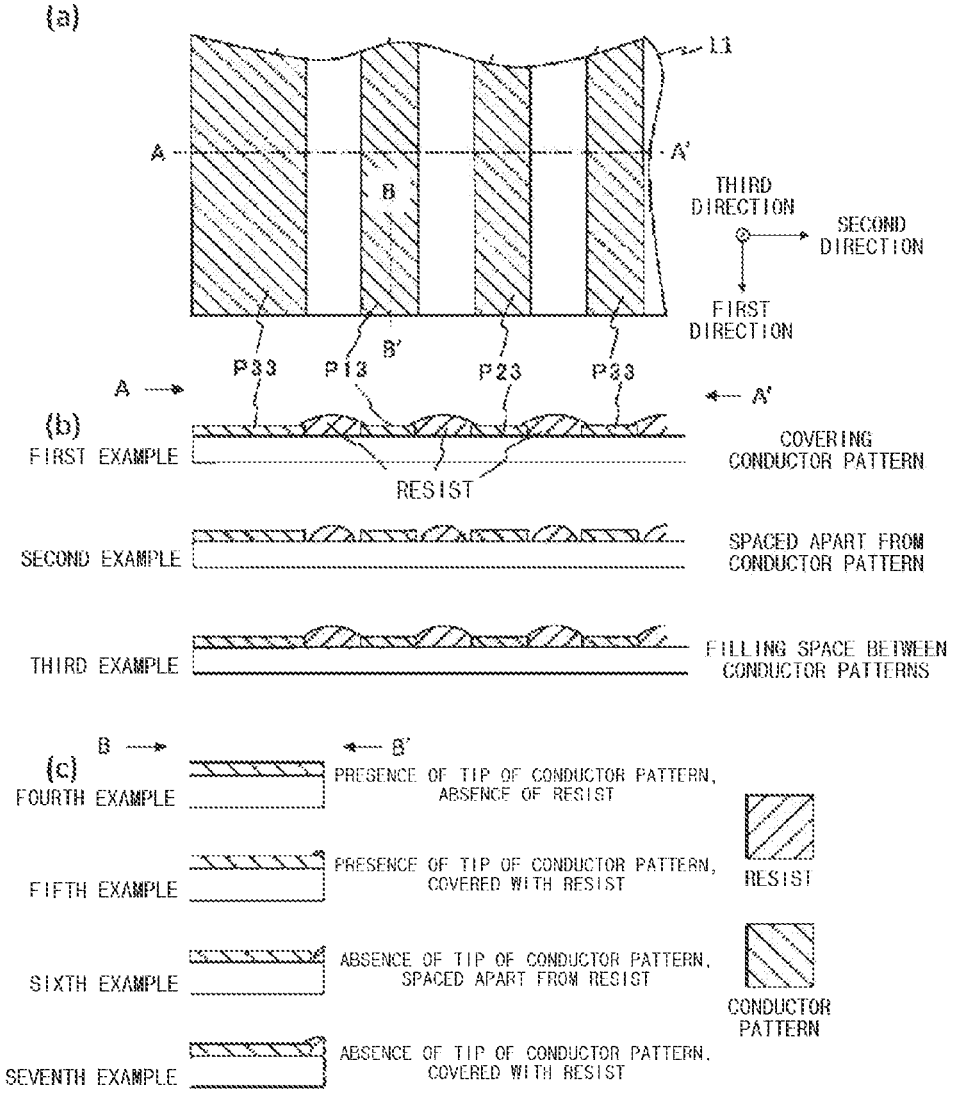
FIG. 11 is a view illustrating examples of a resist structure of a terminal portion.

FIG. 11 is a view illustrating examples of the resist structure of the terminal portion. FIG. 11(*a*) is an enlarged plan view of the terminal portion on the first surface L1. FIG. 11(*b*) is a view illustrating the cross-section taken along line A-A' in FIG. 11(*a*). FIG. 11(*c*) is a view illustrating the cross-section taken along line B-B' in FIG. 11(*a*).

The terminal portions P13, P23 and P33, which are formed on the surface of the rigid substrate 21 and are in contact with the pins of the socket connector to form electrical connections therewith, are arranged along the first side. A resist is formed on the rigid substrate 21.

FIG. 11(*b*) illustrates an example of a resist structure with respect to the respective terminal portions P13, P23 and P33. A first example is a structure in which a resist covers a conductor pattern, a second example is a structure in which a resist is spaced apart from a conductor pattern, and a third example is a structure in which a resist fills the space between conductor patterns (copper foils) and has the same width as the space. In the third example, the distance between the conductor patterns is the same as the width of the resist. The resist may be patterned through photolithography, which will be described later, or may be directly drawn using a dispenser or the like.

There is no great difference between the examples in terms of whether electrical characteristics are deteriorated, but the first example is preferable in terms of prevention of peeling of the copper foil, and the second example is preferable in terms of prevention of contact failure attributable to separation of the pins to portions other than the conductor patterns. However, particularly when the width of the conductor pattern and the distance between the conductor patterns are small (when the density is high), the third example exhibits improved reliability of contact of the pins or stability of electrical connection.

Further, although the surface of the resist is illustrated in the drawing as being formed in a curved shape, the surface may be flat. Furthermore, although the surface of the resist is illustrated in the drawing as being formed at a higher position than the surface of the conductor, the surface of the resist may be formed at a lower position than the surface of the conductor.

FIG. 11(*c*) illustrates an example of the resist structure near the tip of each of the terminal portions P13, P23 and P33 in the B-B' cross section. Fourth and fifth examples are examples in which the tip surface of the conductor pattern is aligned with the first side of the rigid substrate, and sixth and seventh examples are examples in which the tip of the conductor pattern is spaced apart from the tip of the rigid substrate by a predetermined distance. The fourth and sixth examples are examples in which the resist is not formed on the conductor pattern, and the fifth and seventh examples are examples in which the resist is formed on the conductor pattern.

The seventh example, the sixth example, the fifth example, and the fourth example are excellent in this order in terms of prevention of peeling of the copper foil. However, considering the concern of damage to the resist by the pins of the socket connector, a structure in which the resist is not formed in the region between each of the terminal portions P13, P23 and P33 of the conductor pattern and the first side, like the fourth example, is preferable. Further, considering also the compatibility with the electrical characteristics, a structure (not shown) in which the tip of the conductor pattern is spaced apart from the tip of the rigid substrate by a predetermined distance and the resist is not formed in the region between each of the terminal portions P13, P23 and P33 of the conductor pattern and the first side is particularly preferable.

(Method of Manufacturing Rigid Substrate)

Next, a method of manufacturing the rigid substrate 21 will be described. As described above, the rigid substrate 21 is configured as a four-layered substrate in which the first surface L1 and the second surface L2 thereof form surface conductive layers and include therein intermediate conductive layers corresponding to the two inner surfaces L3 and L4. The following description relates to the manufacture of a wiring substrate having four conductor layers, which is formed by bonding a double-sided substrate having copper films, which serve as two conductive layers on the first surface L1 and the first inner surface L3, on both surfaces thereof and a double-sided substrate having copper films, which serve as two conductive layers on the second inner surface L4 and the second surface L2, on both surfaces thereof. As long as the required thickness and accuracy of the insulating layer are capable of being secured, a wiring substrate having four conductor layers may be manufactured in the manner of stacking insulating layers and conductor layers, which serve as surface conductor layers corresponding to the first surface L1 and the second surface L2, on and under a double-sided plate, which includes an intermediate conductive layer corresponding to the first inner surface L3 and an intermediate conductive layer corresponding to the second inner surface L4.

(Preparation of Manufacture)

A panel (copper-clad laminate), in which copper films are formed on both surfaces thereof, with the base material made of an insulator interposed therebetween, is prepared. The base material may include, for example, a cured product of epoxy resin, phenol resin, liquid crystal polymer, or polyimide resin, and may include therein a woven or non-woven fabric made of glass fiber, aramid fiber, or the like. Particularly, a lightweight and highly reliable rigid substrate may be obtained using a resin having thermosetting and low thermal expansion properties. Further, a flexible substrate using a resin film may be considered as an insulating base material in terms of weight reduction, but a support member for securing mechanical strength is required in order to apply the same to the pins of the connector, and it is difficult to secure bonding strength between the conductor film pattern and the film. On the other hand, a rigid substrate, in which a base material has predetermined strength and with which it is easy to secure required bonding strength, is preferable.

In the rigid substrate 21, the coefficient of variation of the in-plane thickness distribution of the base material layer between the signal line and the intermediate conductor layer (a value obtained by dividing standard deviation by average×100(%)) is preferably 5% or less, and is more preferably 3% or less. In the manufacturing method of the present embodiment, the distance between the copper films of the panel used herein is the distance between the signal line and the fixed potential plane on the rigid substrate 21. Unlike the case in which an uncured or semi-cured insulating layer and a copper film are stacked on a patterned conductor and are then fully cured through thermocompression bonding, it is possible to easily obtain a configuration in which the distance between copper films is controlled with high accuracy. Further, even in the case of a thickness that is difficult to obtain when stacked on another copper-clad laminate, for example, even when the thickness of the base material layer is 200 μm or more, it is possible to easily obtain a configuration in which the in-plane thickness distribution is small.

A plated copper foil or a rolled copper foil may be used for the copper film on the surface of the rigid substrate 21, but because mechanical stress is applied to the end of the pattern on the rigid substrate 21 upon insertion into or removal from the socket connector 3, it is preferable to use a copper film of which a roughness (for example, an arithmetic mean roughness Ra) on the base material surface is greater than that on the terminal surface.

(Patterning 1)

A photosensitive resist layer is formed on the copper film of the prepared panel, and exposure and development are performed to form an etching mask composed of patterns of the photosensitive resist. Subsequently, the copper located in the opening in the mask is removed through etching, and then the mask is removed to form conductor patterns made of copper.

In this case, patterns may be formed both on the side that serves as the intermediate conductive layer and on the side that serves as the surface conductive layer. Alternatively, a pattern may be formed only on the side that serves as the intermediate conductive layer, a bonding process (which will be described later) may be performed, and then conductive patterns may be formed on the copper films on both surfaces of the bonded panel. In the case in which the surface conductive layer is subsequently formed, it is preferable to form a positioning pattern on the intermediate conductive layer and/or the intermediate conductive layer. Further, patterns corresponding to a plurality of rigid substrates 21 may be assigned to one panel. When the patterning of the intermediate conductive layer is not necessary (for example, when the external shape of the rigid substrate 21 and the shape and size of the pattern using the intermediate conductive layer are the same), this process may be omitted, and only the patterning of the surface conductive layer may be performed after the bonding.

Further, although the patterning using a subtractive method has been described above, the conductive pattern may be formed using any of other methods, such as an additive method or a printing method. However, the subtractive method is naturally superior to other methods in terms of uniformity of thickness and strength of adhesion to a base material. Therefore, it is suitable for application to the rigid substrate 21 of the present invention, in which the above characteristics are considered important. The patterning method that is applied may be specified for observing the cross-sectional shape and structure of the conductor pattern.

(Bonding)

Two panels are bonded such that the sides thereof that serve as the inner conductive layers face each other. For example, an adhesive layer including a resin may be formed on one or both of the panels, and the panels may be bonded to each other, and then may be heated and pressed in a vacuum atmosphere so as to be firmly fixed to each other. The adhesive layer may be formed by applying a paste-state or liquid-state adhesive, or may be formed by attaching a film-like adhesive, whereby a rigid substrate 21 including a bonding layer having a small in-plane thickness distribution may be obtained.

Although not particularly limited, it is preferable that the resin be a thermosetting resin, and it is more preferable for the resin to include a component, which is the same as the component of the thermosetting resin included in the base material, as a main component. In one example, the adhesive layer is made of a prepreg including the same resin as the resin constituting the base material. The prepreg may include a woven or non-woven fabric such as glass cloth, but it is preferable that the number of plies thereof be less than the number of plies (number of layers) of the woven or non-woven fabric in the base material. The adhesive layer may include a filler. The filler may be an insulating material such as silica or metal oxide, but it is possible to further ensure electrical contact between the inner conductive layers of the rigid substrate 21 using a conductive filler such as copper or silver.

As such, since the distance between the signal line and the fixed potential plane (the distance between the first surface L1 and the first inner surface L3 and the distance between the second inner surface L4 and the second surface L2) is fixed first, it is possible to easily control the position of each conductive layer in the thickness direction and the total thickness of the substrate by adjusting the thickness of the adhesive layer without causing variation in the transmission characteristics. Further, unlike the case in which an outer conductive layer is stacked on a panel including inner conductive layers on both surfaces thereof, even when the distance between the first inner surface L3 and the second inner surface L4 is small (for example, 0 mm or more and less than 0.1 mm), it is possible to prevent variation in the thickness of the substrate, variation in the distance between the signal line and the fixed potential plane, and unevenness of the substrate in the plane direction from increasing.

(Formation of Via)

A via is formed in order to connect the respective conductive layers in the vertical direction. First, a through-hole is formed at a predetermined position in the bonded panels. The through-hole may be formed using a laser, but formation using a mechanical drill is preferable in that variation in the hole diameter in the depth direction of the through-hole is reduced.

In one example, when the distance from the interface between the upper conductive layer and the base material to the interface between the intermediate conductive layer and the base material (=thickness of the base material in the panel) in the depth direction of the through-hole is 1, and when the cross-sectional area of the hole at a position that is located a distance of 0.1 from the interface between the upper conductive layer and the base material is defined as a first hole area, the cross-sectional area of the through-hole at a position that is located a distance of 0.9 from the interface falls within a range from 0.9 times to 1.1 times the first hole area. The through-hole also penetrates the other bonded panel, and, in the base material of the other panel, the cross-sectional area of the through-hole at a position that is located a distance of 0.9 from the interface between the intermediate conductive layer and the base material falls within a range from 0.9 times to 1.1 times the first hole area.

Subsequently, in order to realize electrical connection between the conductive layers, a conductive path made of a conductive material is formed in the through-hole. First, a conductive film is formed so as to cover at least the inner wall of the through-hole. For example, after a thin metal layer (a seed layer) is formed on the inner wall through electroless plating, a thick film made of metal may be formed through electrolytic plating. It may be formed through plating until the through-hole is completely filled, but it is preferable to fill the through-hole with an insulating resin after forming a metal film having a predetermined thickness. Alternatively, it is more preferable to form a via by charging a conductive paste into the hole and curing the same.

Further, in order to reduce the risk of defects attributable to misalignment between through-holes for formation of a via, a so-called via land, which is a pattern formed by enlarging a conductor pattern around the through-hole, may be formed. However, the via land may form a discontinuous point of impedance in a signal line adjacent thereto. Therefore, when a via is formed in at least a region between the soldering position of the pad and the contact position of the pin, it is preferable to form the via in a linear pattern shape without forming a via land. Misalignment between through-holes may be prevented by setting the diameter of a drill (corresponding to the diameter of a hole) to 0.2 mm or more and limiting the number of panels to be stacked during drilling.

(Patterning 2)

At this time, the upper conductive layer corresponding to the first surface L1 and/or the lower conductive layer corresponding to the second surface L2 may be patterned. The same method as that described in Patterning 1 may be applied as a patterning method.

(Formation of Surface Protective Layer)

A surface protective layer made of an insulating material is formed on the conductive pattern having the surface obtained through patterning, and then regions, which are to be terminal portions and pad portions, are opened through exposure and development. The surface protective layer functions as a plating resist in a subsequent plating process, a solder resist in a solder film formation process or a soldering process, and/or a protective film for preventing unnecessary contact of the conductor pattern or damage to the conductor pattern.

(Formation of Protective Layer on Surface of Conductive Pattern)

A pattern protective layer is formed on the surface of the conductive pattern of the outer conductive layer. Au plating is formed on the surface of the conductive pattern in the region that is to become a pin. It is preferable to perform undercoat plating using Ni before forming the Au plating. Before or after forming the Au plating, a solder layer is formed on the surface of the conductive pattern in the region that is to become a pad later. Leveler treatment, plating, coating, and subsequent reflow treatment may be performed for formation of the solder layer. The surface treatment of the pad region may be pre-flux treatment. Further, when the pattern protective layer is formed on one of the pin or the pad, it is preferable to protect the conductor pattern of the other one of the pin and the pad using a temporary resist and to finally remove the temporary resist.

When at least one of these pattern protective layers is formed through electrolytic plating, plating for supplying plating current to the individual conductive patterns is required. A power supply line may be drawn from the side of the rigid substrate that is oriented toward the pin, or may be drawn from the side of the rigid substrate that is oriented from the pad so as to reduce the risk of peeling of the patterns upon insertion into or removal from the socket. The pattern of the power supply line may be integrated with the pad (having the same width), or may be set to be thinner than the pad. However, since the plated power supply line becomes a stub when the connector is used, which has an adverse effect on the transmission characteristics, it is preferable to remove the plated power supply line after forming the surface treatment layer. In particular, removal through etching is preferable in terms of reducing the mechanical stress applied to the conductive patterns.

(External Shape Processing)

A rigid substrate shape is cut out from the panel, on which the surface treatment layer is formed, using a router or the like. Some or all of the aforementioned plated power supply line is formed in a region that is to be removed through the external shape processing, thereby being capable of being removed during the external shape processing.

The above-described processes may be substituted with other processes, as long as there is no problem with regard to reliability. For example, after the formation of the via is performed in advance, patterning and bonding may be performed. Alternatively, after the external shape processing, the surface protective layer and the conductive surface treatment layer may be formed.

(Explanation of Socket Connector)

Figure 12:
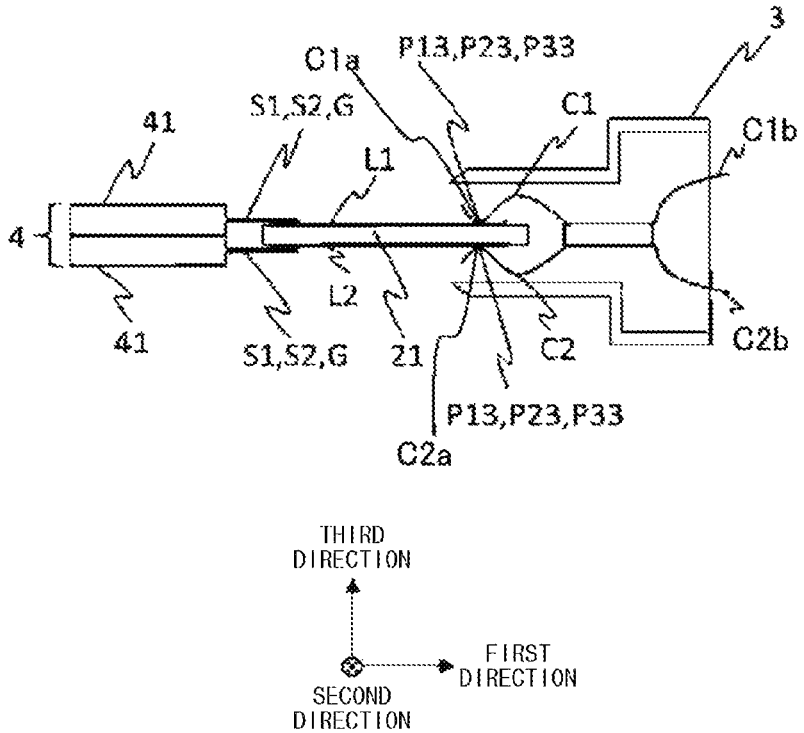
FIG. 12 is a cross-sectional view illustrating an example of a socket connector.

FIG. 12 is a cross-sectional view illustrating an example of the socket connector 3.

The socket connector 3 has therein a plurality of first pins C1 and a plurality of second pins C2, with the rigid substrate 21 of the plug connector 2 interposed therebetween, and the first pins C1 include contacts C1*a*, which respectively come into contact with the terminal portions P13, P23 and P33 on the first surface L1 of the rigid substrate. The second pins C2 include contacts C2*a*, which respectively come into contact with the terminal portions P13, P23 and P33 on the second surface L2 of the rigid substrate.

In the present embodiment, it is assumed that one layer of the cable group 4 is connected to 16 shielded cables 41. There are a total of 49 terminal portions P13, P23 and P33 on the first surface L1. The reason that there are not 48 portions is that there is one pin P33 of the void third conductor pattern that is not connected to the fixed potential line. Therefore, the 49 first pins C1 constitute a first pin group CG1. Similarly, the 49 second pins C2 constitute a second pin group CG2.

The plurality of first pins and the plurality of second pins respectively have first connection terminals C1*b* and C2*b*, which are provided at the ends thereof opposite the contacts C1*a* and C2*a* and are electrically connected to a board on which the components of the electronic device are mounted.

It is preferable that layers made of a precious metal such as gold or palladium be formed on the surfaces of the contacts C1*a* and C2*a*. The contactability or reliability of connection with the terminal portions P13, P23 and P33 may be improved. Further, although each of the contacts C1*a* and C2*a* is illustrated in the drawing as being in contact with a respective one of the terminal portions P13, P23 and P33 at one point, it may be in contact therewith at a plurality of points. With this configuration, it is possible to suppress the occurrence of disconnection, that is, momentary interruption.

In the present embodiment, the plug connector 2 and the socket connector 3 do not have components for signal calculation or conversion. With such a lightweight structure, it is possible to provide high connection reliability even when undergoing vibration including a large amount of acceleration. Also, even in this case, small and lightweight passive components such as a chip capacitor or a chip resistor may be mounted, but an increase in the area of the substrate for installation or addition of the weight of a bonding solder material cannot be ignored, and thus it is particularly preferable not to mount these passive components.

Particularly, a flying body, which flies at a high speed, such as a rocket or an artificial satellite that is loaded on a rocket and launched thereby, is subjected to a very large amount of acceleration. Since the connector system 1 of the present invention uses the rigid substrate 21, it has a simple and lightweight structure, and exhibits improved connectivity between the plug connector 2 and the socket connector 3, whereby it is suitable for data transmission between electronic devices mounted in a flying body.

Figure 13:
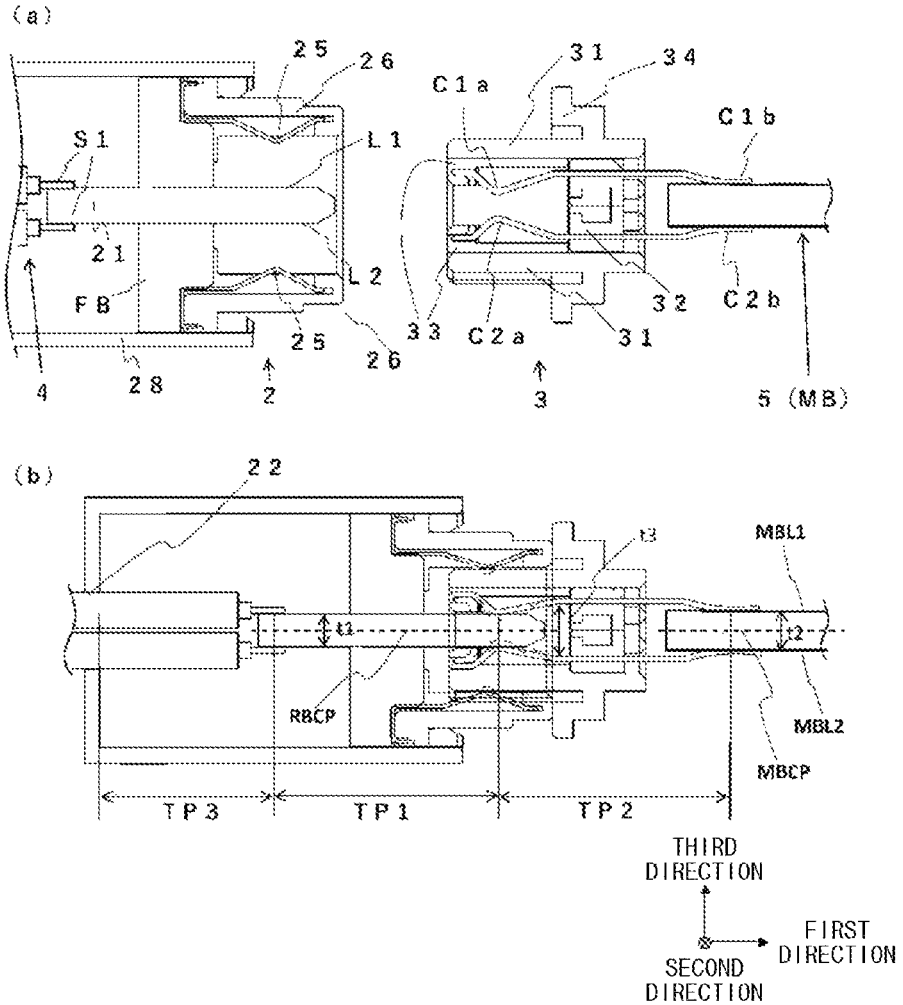
FIG. 13 is a cross-sectional view illustrating connection between a plug connector and a socket connector according to another embodiment.
Figure 14:
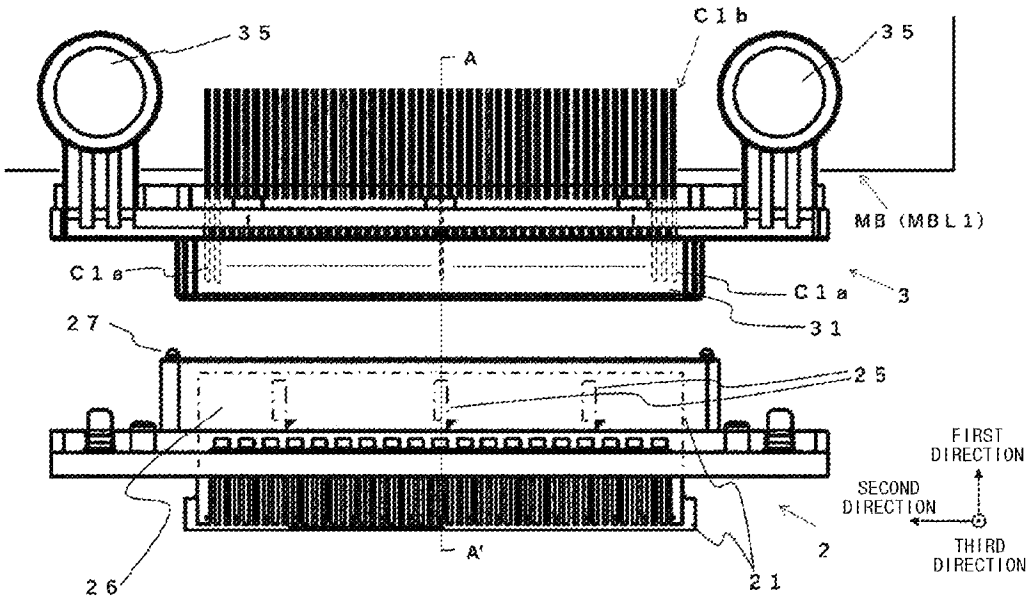
FIG. 14 is a plan view illustrating the plug connector and the socket connector according to the other embodiment.

Connection between a plug connector and a socket connector according to another embodiment will be described with reference to FIGS. 13 and 14. FIG. 13 is a cross-sectional view illustrating connection between a plug connector and a socket connector according to another embodiment, and FIG. 14 is a plan view (a view seen from the third direction). FIGS. 13(*a*) and 14 illustrate the state in which the plug connector 2 and the socket connector 3 are not connected, and FIG. 13(*b*) illustrates the state in which the plug connector 2 and the socket connector 3 are connected and a transmission path TP for transmitting signals is formed. Further, FIG. 13 is a cross-sectional view taken along line A-A' in FIG. 14.

The plug connector 2 has a rigid substrate 21 including a first surface L1 and a second surface L2. First conductor patterns P1 are formed (not shown) on the first surface L1 and the second surface L2, and signal lines S1 of the cables 4 are connected thereto through, for example, soldering. The plug connector 2 further has a rigid substrate support plate FB, which supports the rigid substrate. A frame portion 26 having a pin-holding-plate-pressing portion 25 is further fixed to the rigid substrate support plate. The plug connector 2 may include an exterior part 28 having a cable opening 22. When the exterior part 28 is provided, the cable 4 is capable of being deformed outside the cable opening 22 (the side far from the rigid substrate), but the deformation thereof is restricted inside the cable opening (the side oriented toward the rigid substrate.

The socket connector 3 includes a pin-holding plate 31, and further includes a first pin C1 (C1*a* to C1*b* in the drawings) and a second pin C2 (C2*a* to C2*b* in the drawings), which are formed on the pin-holding plate 31. The first pin C1 has a contact C1*a* at one end thereof and a board connection terminal C1*b* at the opposite end thereof. The second pin C2 has a contact C2*a* at one end thereof and a board connection terminal C2*b* at the opposite end thereof. These board connection terminals C1*b* and C2*b* are connected to a component-mounting board MB of an electronic device 5 via, for example, a solder layer (not shown) so as to support the component-mounting board MB sandwiched therebetween. The first and second pins C1 and C2 are made of a metal having an elastic property, and are fixed in the socket connector 3 by a pin-fixing member 32. The tips of the contacts C1*a* and C2*a* are inserted into a pin guide 33, which is configured as a slit-shaped opening, and are capable of performing reciprocating movement in the vertical direction on the paper sheet of FIG. 13 (the third direction) within the range of the opening in the pin guide 33. When the plug connector 2 and the socket connector 3 are in a non-connected state, the distance between the two contacts C1*a* and C2*a* is set to be less than the thickness t1 of the rigid substrate 21. When the plug connector 2 and the socket connector 3 are engaged together, the contacts thereof are spread and expanded by the rigid substrate 21 inserted therebetween. At this time, the contacts C1*a* and C2*a* are strongly pressed and electrically connected to the terminal portions P13 (not shown) of the conductor patterns, which are formed on the first surface L1 and the second surface L2 of the rigid substrate, by the restoring force formed by the elastic property of the pins C1 and C2. Further, even when the rigid substrate is finely moved or deformed by vibration or the like, the contacts may absorb or follow the movement or deformation due to the elastic property thereof, thereby maintaining high-quality connection and highly reliable transmission characteristics.

Further, since the socket connector 3 comes into contact with a predetermined position of the plug connector 2, the socket connector 3 may have a stopper 34, which defines a distance (minimum distance) by which the socket connector 3 and the plug connector 2 are closest to each other when engaged together.

As shown in FIG. 14, the frame member 26 includes an erroneous-insertion-preventing pin 27. The terminals of the plug connector of the present invention are arranged in a line-symmetrical structure both in the second direction and in the third direction, whereby physical connection and electrical connection may be realized even when rotated, for example, 180 degrees. However, except for special cases, since logical connection is not realized, it is preferable to provide the erroneous-insertion-preventing unit that defines only one direction in which the plug and the connector are rotated at the time of insertion.

Further, the socket connector of the present invention is firmly fixed to the component-mounting board MB via a fixing arm 35. In this way, the number of parts of the plug connector is minimized to reduce the weight, and the plug connector is supported by the socket connector fixed to the component-mounting board, whereby an increase in the weight of the connector system is minimized, and a connection system having high connection reliability is provided.

In the plug connector 2 of FIG. 14, an illustration of the exterior part 28 and the cable 4 is omitted. Further, in this drawing, although the rigid substrate 21 is invisible because it is located in the region overlapping the frame portion 26 and thus is blocked by the frame portion 26, the external shape of the rigid substrate 21 is indicated by the alternate long and short dash line for the sake of explanation. Similarly, although the pin-holding-plate-pressing portion 25 cannot be seen directly because it is blocked by the frame portion 26, an example of the arrangement thereof is indicated by the alternate long and two short dashes line for the sake of explanation. Similarly, with regard to the socket connector 3, invisible regions of some pins C1, which are blocked by the pin-holding plate 31, among the total length of the pins C1, are indicated by the broken lines for the sake of explanation.

The plug connector 2 of the present invention includes a pin-holding-plate-pressing portion 25, which presses the pin-holding plate 31 of the socket connector 3 toward the rigid substrate when engaged with the socket connector 3. The plug connector of the present invention has a high density and high reliability by repeating the same structure over a predetermined length in the second direction, and provides multi-channel high-speed transmission in which the differences in the characteristics between the channels are equally suppressed. However, in this structure, since the pin-holding plate 31 of the socket connector extends long in the second direction, the pin-holding plate 31 may be finely curved by the reaction to the force by which the pin C1 or C2 presses the rigid substrate, and variation in the pressure may occur in the contact C1*a* or C2*a*. However, the pin-holding-plate-pressing portion 25 of the plug connector presses the pin-holding plate so as to suppress bending and variation in the pressure.

The pin-holding-plate-pressing portion may be formed on the inner surface of the frame member 26 of the plug connector 2, and may be formed in the shape of a protrusion that comes into contact with the pin-holding plate 31 at the time of engagement. In particular, it is more preferable to form the pin-holding-plate-pressing portion 25 using a spring-like member, because it is capable of absorbing or following movement or deformation caused by vibration.

The spring-like member may be made of a conductor, and may be used as an electrical connection path of a fixed potential. For example, a film or a layer made of a metal is formed on the outer circumferential surface of the pin-holding plate 31, and the conductive spring member having a fixed potential is brought into contact with the film or the layer, thereby enabling the metallic film or layer on the outer circumferential surface of the pin-holding plate to function as a shield. The spring member is electrically connected to a portion on the rigid substrate, which has the same potential as the shield line of the cable, thereby being easily set to a fixed potential. As an example, the exterior part 28 is made of a conductor such as aluminum, and is electrically connected to a portion on the rigid substrate, which has a fixed potential, and to both sides of the conductive spring member, thereby forming a shield covering the transmission path on the rigid substrate 21.

Further, the pin-holding plate 31 holding the first pin C1 and the pin-holding plate 31 holding the second pin C2 may be connected at the ends thereof to each other via a side wall. However, slits, grooves, or concave portions may be formed in the side wall so as to reduce the support force of the side wall in the third direction. With this configuration, both end portions of the holding plate 31 in the second direction have the same flexibility as the central portion of the holding plate 31, thereby achieving more precise control of the pressure by the pin-holding-plate-pressing portion.

Next, the transmission path TP of the connector system of the present invention will be described. When a transmission path from the connection point between the signal line S1 and the pad portion P11 on the rigid substrate 21 to the connection point between the terminal portion P13 and the contact C1*a* via the wiring portion P12 is defined as TP1, and when a transmission path from the connection point between the terminal portion P13 and the contact C1*a* to the connection point between the first board connection terminal C1*b* and the conductor pattern (not shown) on the first surface MBL1 of the component-mounting board MB is defined as TP2, the transmission path formed by TP1 and TP2 extends substantially linearly when viewed in section, as shown in FIG. 13(*b*). When the thickness of the rigid substrate 21 is defined as t1, when the thickness of the component-mounting board MB is defined as t2, and when the distance between C1 and C2 at the positions where C1 and C2 are spaced farthest from each other within the transmission path TP2 is defined as t3, the difference between t3 and t2 (t3−t2) may be less than t2. Further, the difference between t3 and t1 (t3−t1) may be less than t1. Further, it is preferable that t1 be less than t2. Furthermore, the transmission path TP1 and the transmission path TP2 are configured so as to be located on the same straight line when viewed from the third direction.

With some or all of the above configuration, the transmission paths TP1 and TP2 form a linear transmission path, which extends a substantially minimum distance from the signal line S1 to a predetermined connection point on the component-mounting board MB, thereby exhibiting very excellent transmission characteristics.

Further, in the connector system of the present invention, 30 or more transmission paths are arranged in the second direction. Preferably, 49 or more transmission paths are arranged, and more preferably, the transmission paths are disposed on the top and bottom surfaces of the rigid substrate 21. As a result, it is possible to realize high-density multi-channel connection having excellent transmission characteristics.

The rigid substrate 21 and the component-mounting board MB are arranged so as to have side surfaces facing each other. A first virtual plane RBCP is defined between the first surface L1 and the second surface L2 of the rigid substrate 21 such that the distance from the first surface L1 and the distance from the second surface L2 are the same. Similarly, a second virtual plane MBCP is defined between the first surface MBL1 and the second surface MBL2 of the component-mounting board such that the distance from the first surface MBL1 and the distance from the second surface MBL2 are the same. In this case, the plug connector and the socket connector may be engaged with each other such that the first virtual plane RBCP is located between the first surface MBL1 and the second surface MBL2 of the component-mounting board. Further, the plug connector and the socket connector may be engaged with each other such that the second virtual plane MBCP is located between the first surface L1 and the second surface L2 of the rigid substrate. In particular, it is more preferable that the first virtual plane RBCP and the second virtual plane MBCP be located at the same position.

Further, the transmission path formed by TP1 and TP2, which include the transmission path on the first surface L1 of the rigid substrate, is configured not to intersect the second virtual plane MBCP. Further, the transmission path formed by TP1 and TP2, which include the transmission path on the second surface L2 of the rigid substrate, is configured not to intersect the second virtual plane MBCP.

With the above configuration, a linear transmission path, which hardly moves in the third direction, is provided.

The transmission path TP including the signal line S1 and the first conductor pattern P1 has been described above by way of example. Similarly, according to another embodiment, a transmission path TP including the signal line S2 and the second conductor pattern P2 or a transmission path TP including the shield line G and the third conductor pattern P3 may also have the same configuration. Further, since the signal transmission patterns formed by the above components are arranged in accordance with the number of channels, a multi-channel connector system having excellent transmission characteristics and uniform transmission characteristics is provided.

The cable 4 may include a transmission path TP3 in the vicinity of the rigid substrate 21, in which the signal line S1 extends on the first surface L1 or the second surface L2 of the rigid substrate. This configuration may be easily obtained by restricting bending using the cable opening 22, as shown in FIG. 13(*b*).

(Example of Use of Connector System)

Figure 15:
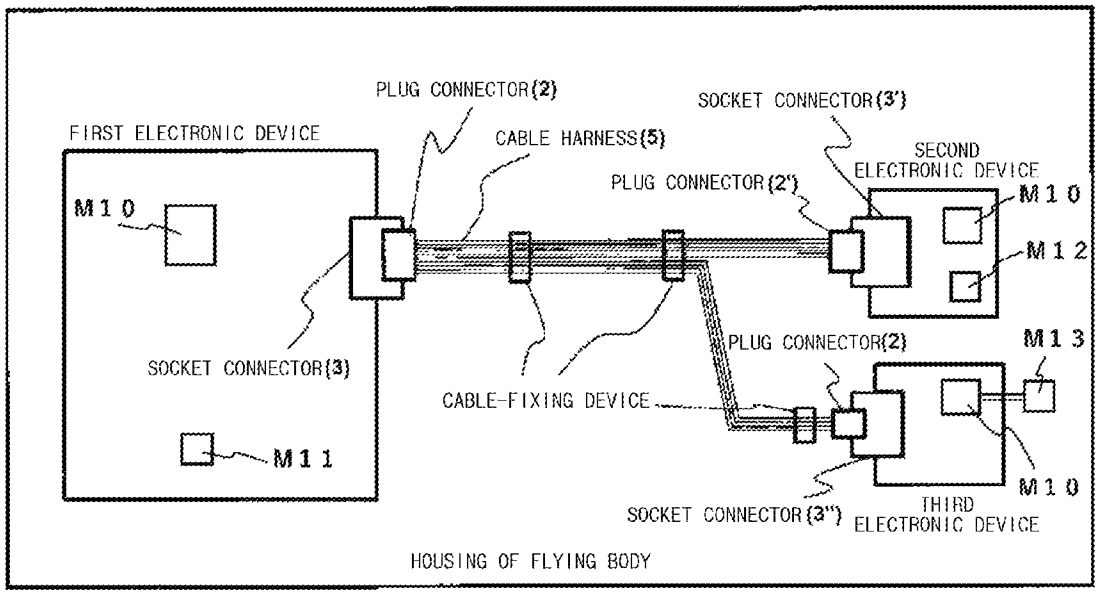
FIG. 15 is a diagram illustrating an example of a flying body equipped with the connector system 1.

FIG. 15 is a diagram illustrating an example of use of the connector system 1. In the present embodiment, three electronic devices are provided in a housing of a flying body. The first electronic device is, for example, a main control device that performs posture control or observation. A first component-mounting board MB is included, and a computing device M10 and a memory device M11 are mounted on the component-mounting board MB. The computing device M10 is, for example, a CPU, and an external terminal thereof is connected to a component electrode on the component-mounting board MB via, for example, a solder layer. A plurality of wires, which extends from the board connection terminal C1*b* (or C2*b*) of the socket connector 3 of the present invention to the component electrode, is formed on the component-mounting board MB.

The computing device M10 includes therein a communication block having, for example, an LVDS receiver and/or an LVDS driver, and transmits and receives differential signals to and from an external device through the cable 4, the socket connector 3, the plug connector 2, and the wires on the component-mounting board.

The second electronic device is, for example, a high-definition camera. The second electronic device includes a second component-mounting board, and the socket connector of the present invention, a computing device M10, and a sensor M12 are mounted on the second component-mounting board. The computing device M10 of the second electronic device performs necessary processing on the information acquired by the sensor M12, and a communication block in M10 transmits and receives differential signals to and from the first electronic device through wires on the second component-mounting board MB, a socket connector 3', and a plug connector 2'.

The third electronic device is, for example, a posture control device. An actuator M13 is controlled by a computing device M10. A communication block in the computing device, like the other electronic devices, transmits and receives differential signals through wires on a component-mounting board of the third electronic device, a socket connector 3", a plug connector 2", and cables.

Further, in some or all of the electronic devices, the communication block is not necessarily mounted in the computing device M10, and may be mounted separately. Further, in relation to the cable harness used for connection between the electronic devices, all of the end portions thereof are not necessarily the plug connectors of the present invention. When at least one end portion is the plug connector of the present invention, the other end portion may be directly soldered to the pad on the component-mounting board, or may be another plug connector.

Here, it is preferable for the component-mounting board of the first electronic device to be composed of only conductor patterns formed on the first surface MBL1 of the component-mounting board and to include a plurality of wires, which extends from the connection position with the board connection terminal C1*b* (or C2*b*) of the socket connector 3 to the component electrode. With this configuration, it is possible to form a plurality of transmission paths composed of only substantially the same layers from the component electrode to the cable.

For example, through multi-channel transmission using the cable harness CH, the control device may analyze an image from the high-definition camera, and may control the posture control device so that an appropriate image may be captured.

The electronic devices respectively have socket connectors 3, 3' and 3", which have different numbers of connection channels. The cable harness CH is composed of a cable group 4 and plug connectors 2, 2' and 2" connected to one end or both ends of the cable group 4.

When the number of channels of the cable harness is 32, the connector system for the first electronic device is capable of performing transmission through up to 32 channels, and the cable harness CH branches from the second electronic device and the third electronic device. The total number of channels of the plug connector 2' and the plug connector 2" is 32 or less.

The plug connector according to the present invention is reduced in weight, and enables high-speed digital multi-channel transmission exhibiting excellent reliability and versatility.

It should be understood that those skilled in the art can make various changes, substitutions, and modifications hereto without departing from the spirit and scope of the present invention.

In relation to the above-described embodiments, supplementary notes set forth below are further provided.

The invention claimed is:

1. A plug connector comprising a rigid substrate having a first surface and a second surface formed opposite the first surface, wherein each of the first surface and the second surface of the rigid substrate comprises a first side and a second side formed opposite the first side, wherein the rigid substrate comprises a plurality of signal transmission patterns formed on the first surface and the second surface to transmit a differential signal, wherein the plurality of signal transmission patterns comprises a first signal transmission pattern formed on the first surface of the rigid substrate, a second signal transmission pattern formed on the second surface of the rigid substrate, a third signal transmission pattern formed at a position adjacent to the first signal transmission pattern on the first surface, and a fourth signal transmission pattern formed at a position adjacent to the second signal transmission pattern on the second surface, wherein the plurality of signal transmission patterns comprises a first conductor pattern, a second conductor pattern forming a differential pair with the first conductor pattern, and a third conductor pattern having a fixed potential, wherein each of the first conductor pattern, the second conductor pattern, and the third conductor pattern comprises a terminal portion electrically connected to a terminal of another connector, a pad portion electrically connected to a cable, and a wiring portion electrically connecting the terminal portion and the pad portion and is in a linear shape, and wherein the terminal portion of each of the first, second and third conductor patterns of the plurality of signal transmission patterns is formed along the first side, and the pad portion of each of the first, second and third conductor patterns is formed along the second side.

2. The plug connector of claim 1, wherein the rigid substrate comprises a third side located between the first side and the second side and a fourth side formed opposite the third side, and a distance between the first side and the second side is less than a distance between the third side and the fourth side.

3. The plug connector of claim 1, wherein, in each of the first conductor pattern, the second conductor pattern, and the third conductor pattern, the wiring portion is formed in a straight line connecting the terminal portion and the pad portion, to which the wiring portion is connected.

4. The plug connector of claim 1, wherein a distance between the first side of the first surface of the rigid substrate and the pad portion is less than 0.1% of a wavelength of the differential signal.

5. A plug connector comprising a rigid substrate having a first surface and a second surface formed opposite the first surface, wherein each of the first surface and the second surface of the rigid substrate comprises a first side and a second side formed opposite the first side, wherein the rigid substrate comprises a plurality of signal transmission patterns formed on the first surface and the second surface to transmit a differential signal, and a first inner surface, formed along the first surface and having a first conductor plate, and a second inner surface, formed along the second surface and having a second conductor plate, and a distance between the first conductor plate and the second conductor plate is less than a distance between the first conductor pattern formed on the first surface and the first conductor plate wherein the plurality of signal transmission patterns comprises a first signal transmission pattern formed on the first surface of the rigid substrate, a second signal transmission pattern formed on the second surface of the rigid substrate, a third signal transmission pattern formed at a position adjacent to the first signal transmission pattern on the first surface, and a fourth signal transmission pattern formed at a position adjacent to the second signal transmission pattern on the second surface, wherein the plurality of signal transmission patterns comprises a first conductor pattern, a second conductor pattern forming a differential pair with the first conductor pattern, and a third conductor pattern having a fixed potential, wherein each of the first conductor pattern, the second conductor pattern, and the third conductor pattern comprises a terminal portion electrically connected to a terminal of another connector, a pad portion electrically connected to a cable, and a wiring portion electrically connecting the terminal portion and the pad portion, and wherein the terminal portion of each of the first, second and third conductor patterns of the plurality of signal transmission patterns is formed along the first side, and the pad portion of each of the first, second and third conductor patterns is formed along the second side.

6. A connector system comprising a plug connector, comprising a rigid substrate having a first surface and a second surface formed opposite the first surface, and a socket connector, comprising a plurality of pins supporting the first surface and the second surface of the rigid substrate sandwiched therebetween, wherein a plurality of conductor patterns is formed on the first surface and the second surface of the rigid substrate so as to extend parallel to each other, each of the plurality of conductor patterns having a pad portion formed at one end thereof for connection with a cable and a terminal portion formed at an opposite end thereof for contact with a respective one of the pins, wherein the plurality of pins of the socket connector is configured such that end portions thereof opposite portions supporting the rigid substrate sandwiched therebetween support a top surface and a bottom surface of another wiring substrate sandwiched therebetween, wherein the rigid substrate comprises a first signal transmission pattern formed on the first surface, a second signal transmission pattern formed on the second surface of the rigid substrate, a third signal transmission pattern formed on the first surface at a position adjacent to the first signal transmission pattern, and a fourth signal transmission pattern formed on the second surface at a position adjacent to the second signal transmission pattern, wherein the plurality of signal transmission patterns comprises three conductor patterns disposed adjacent to each other, the three conductor patterns comprising a first conductor pattern, a second conductor pattern forming a differential pair with the first conductor pattern, and a third conductor pattern having a fixed potential, and wherein, when a plane located between the top surface and the bottom surface of the other wiring substrate such that a distance from the top surface and a distance from the bottom surface are identical is defined as a first virtual plane, a transmission path composed of three conductor patterns constituting the first signal transmission pattern and three pins configured to be in contact with terminal portions of the three conductor patterns does not intersect the first virtual plane, and a transmission path composed of three conductor patterns constituting the second signal transmission pattern and three pins configured to be in contact with terminal portions of the three conductor patterns does not intersect the first virtual plane.

7. A flying body comprising a plug connector described in claim 1.

8. A flying body comprising a connector system described in claim 6.

9. A plug connector comprising a rigid substrate having a first surface and a second surface formed opposite the first surface, wherein each of the first surface and the second surface of the rigid substrate comprises a first side and a second side formed opposite the first side, wherein the rigid substrate comprises a plurality of signal transmission patterns formed on the first surface and the second surface to transmit a differential signal, wherein the plurality of signal transmission patterns comprises a first signal transmission pattern formed on the first surface of the rigid substrate, a second signal transmission pattern formed on the second surface of the rigid substrate, a third signal transmission pattern formed at a position adjacent to the first signal transmission pattern on the first surface, and a fourth signal transmission pattern formed at a position adjacent to the second signal transmission pattern on the second surface, wherein the plurality of signal transmission patterns comprises a first conductor pattern, a second conductor pattern forming a differential pair with the first conductor pattern, and a third conductor pattern having a fixed potential, wherein each of the first conductor pattern, the second conductor pattern, and the third conductor pattern comprises a terminal portion electrically connected to a terminal of another connector, a pad portion electrically connected to a cable, and a wiring portion electrically connecting the terminal portion and the pad portion, and wherein the terminal portion of each of the first, second, and third conductor patterns of the plurality of signal transmission patterns is formed along the first side, and the pad portion of each of the first, second, and third conductor patterns is formed along the second side and the first, second, and third conductor patterns have the same conductor width.

10. A flying body comprising a plug connector described in claim 5.

* * * * *